US009286818B2

(12) United States Patent
Asanuma

(10) Patent No.: US 9,286,818 B2
(45) Date of Patent: Mar. 15, 2016

(54) CALIBRATION APPARATUS AND METHOD FOR CONTROLLING THE SAME

(71) Applicant: CANON KABUSHIKI KAISHA, Tokyo (JP)

(72) Inventor: Tomoya Asanuma, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 280 days.

(21) Appl. No.: 13/927,916

(22) Filed: Jun. 26, 2013

(65) Prior Publication Data

US 2014/0009485 A1 Jan. 9, 2014

(30) Foreign Application Priority Data

Jul. 3, 2012 (JP) ..... 2012-149642
Apr. 23, 2013 (JP) ..... 2013-090044

(51) Int. Cl.
*G09G 5/02* (2006.01)
*G09G 3/00* (2006.01)

(52) U.S. Cl.
CPC ..... *G09G 3/006* (2013.01); *G09G 5/02* (2013.01); *G09G 2320/0693* (2013.01)

(58) Field of Classification Search
None
See application file for complete search history.

(56) References Cited

U.S. PATENT DOCUMENTS

2009/0213434 A1 * 8/2009 Ito et al. ..... 358/3.23

FOREIGN PATENT DOCUMENTS

JP 09-224161 A 8/1997

* cited by examiner

*Primary Examiner* — Yingchun He
(74) *Attorney, Agent, or Firm* — Fitzpatrick, Cella, Harper & Scinto

(57) ABSTRACT

The present invention is a calibration apparatus comprising a calibration unit configured to perform calibration for an image display apparatus; an acquiring unit configured to acquire a color deviation direction that represents a direction of deviation in a color space between a color measurement value and a theoretical value, for each of color patches of a plurality of colors after executing the calibration; and a control unit configured to determine degrees of similarity of the color deviation directions in relation to the color patches of at least some of the plurality of colors included in the plurality of colors and control whether or not the calibration unit is allowed to perform the calibration for the image display apparatus again, on the basis of a result of the determination.

25 Claims, 29 Drawing Sheets

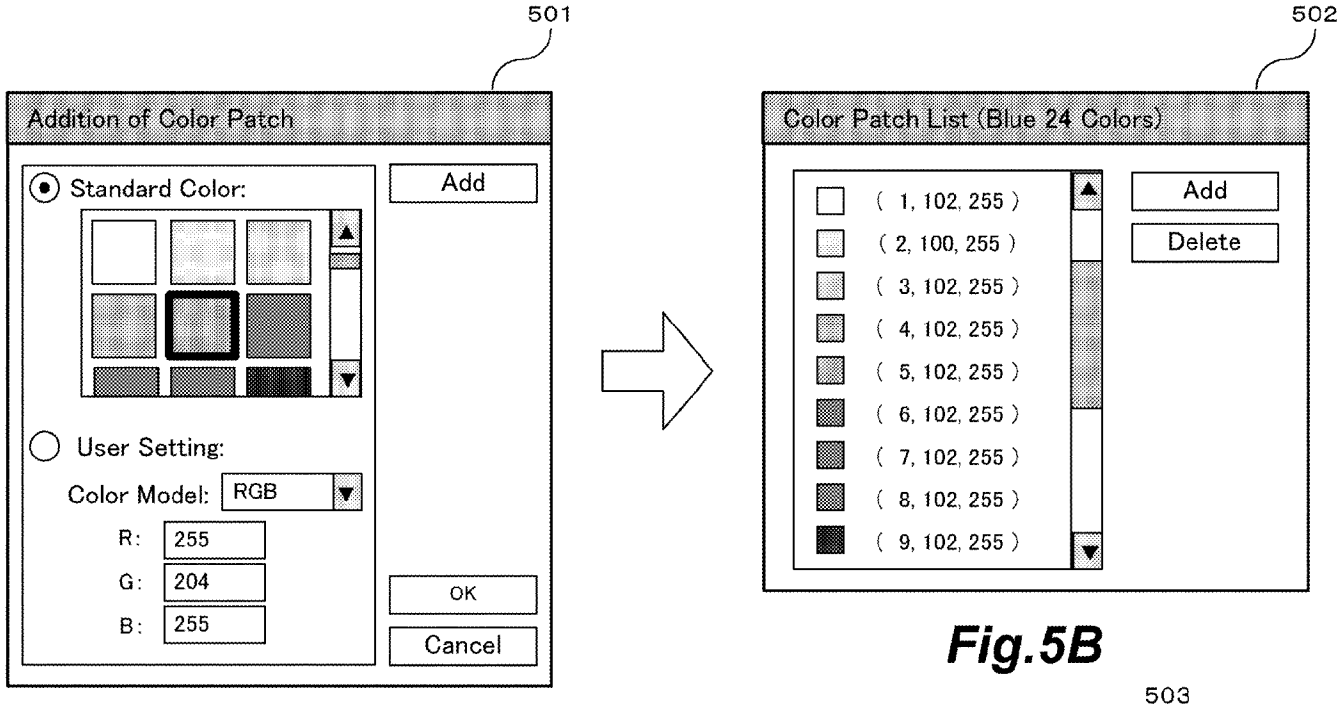
Fig.5A
Fig.5B
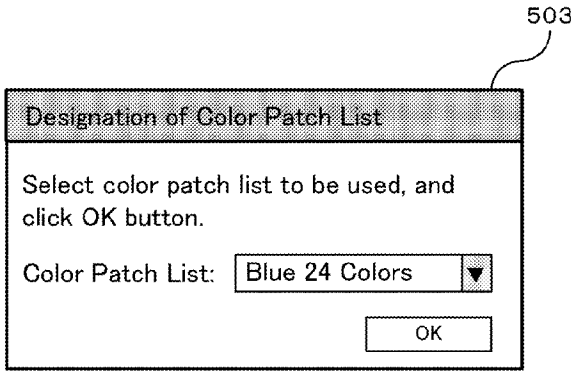
Fig.5C

801

Display of Result of Calibration

Calibration is completed.

| | Target | Result |
|---|---|---|
| Color Gamut: | | |
| R: | x=0.3330, y=0.1234 | x=0.3330, y=0.1234 |
| G: | x=0.3330, y=0.1234 | x=0.3330, y=0.1234 |
| B: | x=0.3330, y=0.1234 | x=0.3330, y=0.1234 |
| White Point: | 5000 K | x=0.3330, y=0.1234 |
| Brightness: | 200 cd/m2 | 200 cd/m2 |
| Gamma: | R: 2.20 | |
| | G: 2.20 | |
| | B: 2.20 | |

*Fig.8*

1001

Display of Verification Result

Verification result is as follows.

Time and Date of Verification : 2011.9.2 16:22:50

Name of Adjustment Result to Be Verified :20110909_AdobeRGB_200cd

Color Patch List: Macbeth 24 Colors

| | Color Patch | Theoretical Value (Lab) | Measured Value (Lab) | ⊿E |
|---|---|---|---|---|
| 1 | (1,15,252) | (−90.1,−25.2,−80.0) | (−90.1,−25.2,−80.0) | 1.2 |
| 2 | (2,15,252) | (90.1,25.2,8.0) | (90.1,25.2,8.0) | 3.1 |
| 3 | (3,15,252) | (9.1,−2.2,−8.0) | (9.1,−2.2,−8.0) | 3.1 |
| 4 | (4,15,252) | (−90.1,−25.2,−80.0) | (−90.1,−25.2,−80.0) | 1.2 |
| 5 | (5,15,252) | (−90.1,−25.2,−80.0) | (−90.1,−25.2,−80.0) | 3.2 |
| 6 | (6,15,252) | (−90.1,−25.2,−80.0) | (−90.1,−25.2,−80.0) | 1.2 |
| 7 | (7,15,252) | (−90.1,−25.2,−80.0) | (−90.1,−25.2,−80.0) | 2.3 |
| 8 | (8,15,252) | (−90.1,−25.2,−80.0) | (−90.1,−25.2,−80.0) | 0.2 |

*Fig.10*

Possibility is low to improve reproduction accuracy for designated colors by performing recalibration. Do you perform recalibration?

Yes No

Possibility is high to improve reproduction accuracy for important colors by performing recalibration. Do you perform recalibration?

Yes No

CALIBRATION APPARATUS AND METHOD FOR CONTROLLING THE SAME

BACKGROUND OF THE INVENTION

1. Field of the Invention

The present invention relates to a calibration apparatus and a method for controlling the same for executing the calibration process (calibration) to be performed by using a color measuring sensor (colorimetric sensor) in order to maintain a correct and constant image quality of a monitor.

2. Description of the Related Art

In recent years, the importance of color management is progressively increased in order to unify outputted colors by adjusting the colors among devices which deal with images, including, for example, monitors, digital cameras, and printers. In the color management, the image data is transmitted and received by using the color reproduction gamut (color reproduction region) which does not depends on the respective devices such as the monitor, the printer and the like, and the correct color reproduction is realized in relation to the outputs of the respective devices.

In particular, it is necessary to always effect the reproduction stably at a high accuracy in relation to the colors outputted from the monitor which is used for such an operation that the correct colors are dealt with, including, for example, the editing of the still image and the confirmation of the printed matter. Therefore, the important point, which is important especially in the color management, is to accurately perform the calibration process=calibration which is performed periodically in order to maintain the constant reproducibility of colors outputted by the monitor.

A conventional technique, which relates to the calibration as described above, is described in Japanese Patent Application Laid-open No. 09-224161, wherein a plurality of calibration setting systems, in which the color reproduction accuracy and the calculation time differ, are stored, and the stored calibration setting systems are selected and instructed. Further, a calibration apparatus is disclosed, which is provided with a calculating unit for executing the calibration calculation on the basis of the selected and instructed calibration setting system.

Further, a calibration apparatus exists, which is provided with a verifying function as the function to confirm the degree or extent of color reproduction accuracy of a monitor as a result of the execution of calibration.

SUMMARY OF THE INVENTION

In the case of the conventional verifying function, ΔE is calculated after the calibration in relation to any specified color, and the obtained result is displayed with numerical value. Accordingly, it is presented for a user whether or not the color reproduction accuracy of the monitor is satisfactory. However, in the case of the verifying function as described above, it has been impossible for the user to determine whether or not the color reproduction accuracy of the monitor, which is to be adjusted by the calibration, may be possibly further improved, and determine at which point in time the best state of the monitor is to be provided.

Therefore, the user has been performed, for example, the following operation. That is, the user confirms the numerical value of ΔE of any anxious color after the calibration, and then the user confirms again the state of the monitor after the calibration by viewing an actual image. Therefore, for example, if the accuracy of a certain interested color (noted color) is satisfactory, but another interested color has no satisfactory accuracy, then the user performs the calibration again for the monitor in some cases.

It is assumed that a relationship is provided between the measured values after the calibration and the theoretical values thereof in relation to a plurality of colors (indicated by 1 to 8) designated by a user as shown in FIG. 1A. In this case, the deviations between the measured values after the calibration and the theoretical values are provided in an identical direction. Therefore, if the adjustment (recalibration) is performed so as to effect the supplement in the deviation direction, there is such a possibility that the color reproduction accuracy of the monitor may be improved. On the other hand, as shown in FIG. 1B, if the deviations between the measured values after the calibration and the theoretical values thereof are not provided in an identical direction in relation to a plurality of colors designated by the user, it is considered to be difficult to improve the color reproduction accuracy of the monitor by means of the recalibration.

The present invention provides a technique which makes it possible to appropriately determine whether or not the execution of recalibration is required after performing calibration for an image display apparatus.

According to a first aspect of the present invention, there is provided a calibration apparatus comprising:

a calibration unit configured to perform calibration for an image display apparatus;

an acquiring unit configured to acquire a color deviation direction that represents a direction of deviation in a color space between a color measurement value and a theoretical value, for each of color patches of a plurality of colors after executing the calibration; and a control unit configured to determine degrees of similarity of the color deviation directions in relation to the color patches of at least some of the plurality of colors included in the plurality of colors and control whether or not the calibration unit is allowed to perform the calibration for the image display apparatus again, on the basis of a result of the determination.

According to a second aspect of the present invention, there is provided a method for controlling a calibration apparatus, comprising:

a calibration step of performing calibration for an image display apparatus;

an acquiring step of acquiring a color deviation direction which represents a direction of deviation in a color space between a color measurement value and a theoretical value, for each of color patches of a plurality of colors after executing the calibration; and a control step of determining degrees of similarity of the color deviation directions in relation to the color patches of at least some of the plurality of colors included in the plurality of colors and controlling whether or not the calibration for the image display apparatus is performed again in the calibration step, on the basis of a result of the determination.

According to the present invention, it is possible to appropriately determine whether or not the execution of recalibration is required after performing calibration for the image display apparatus.

Further features of the present invention will become apparent from the following description of exemplary embodiments with reference to the attached drawings.

BRIEF DESCRIPTION OF THE DRAWINGS

FIG. 5A, FIG. 5B, and FIG. 5C show screens to add, register, and designate color patches according to the first embodiment.

FIG. 8 shows a screen to display calibration results according to the first embodiment.

FIG. 10 shows a screen to display verification results according to the first embodiment.

DESCRIPTION OF THE EMBODIMENTS

An explanation will be made below about the best mode for carrying out the present invention with reference to the drawings and the flow charts. However, the present invention is not limited to the following embodiments.

(First Embodiment)

<Explanation of Overall Arrangement>

Figure 1A:
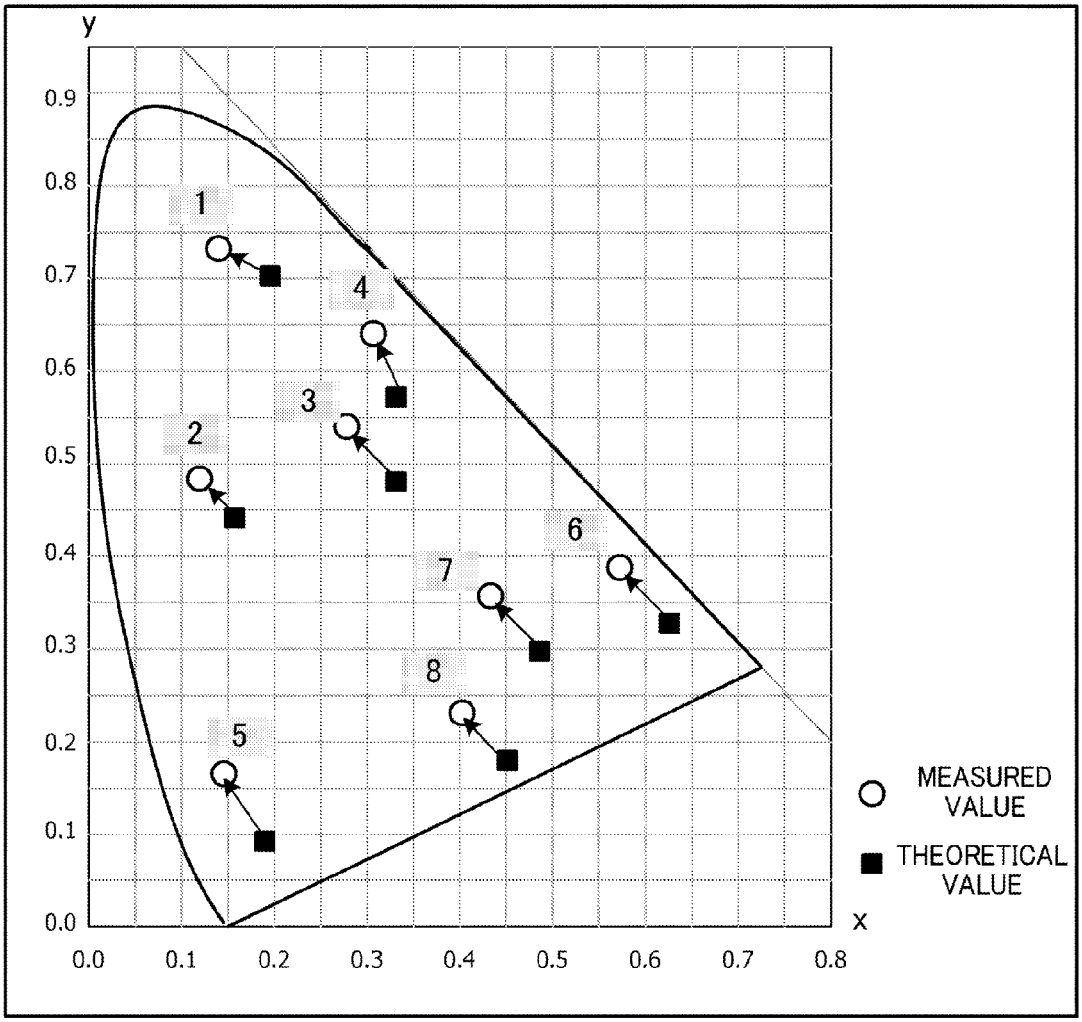
FIG. 1A and FIG. 1B show exemplary deviations between color measurement values and theoretical values after the calibration.
Figure 1B:
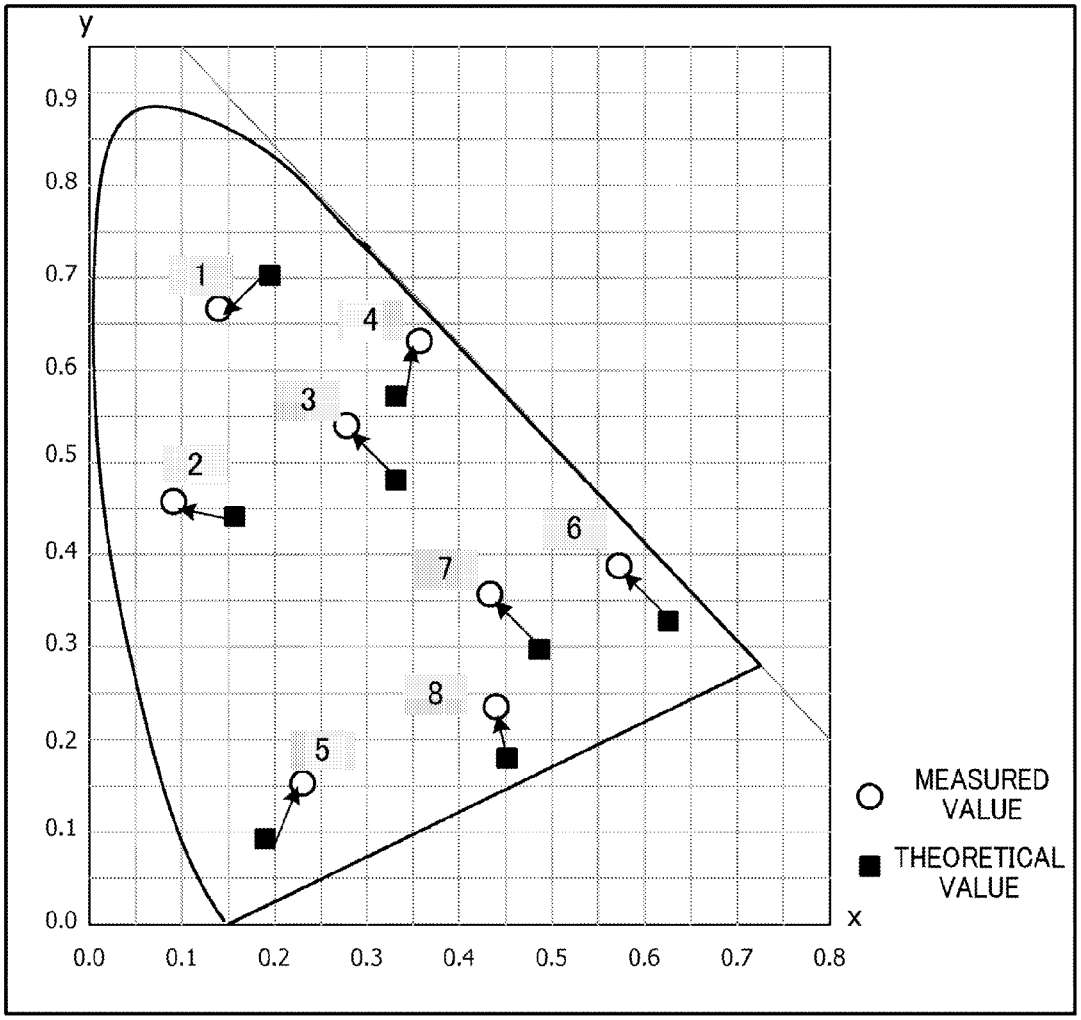
Figure 2A:
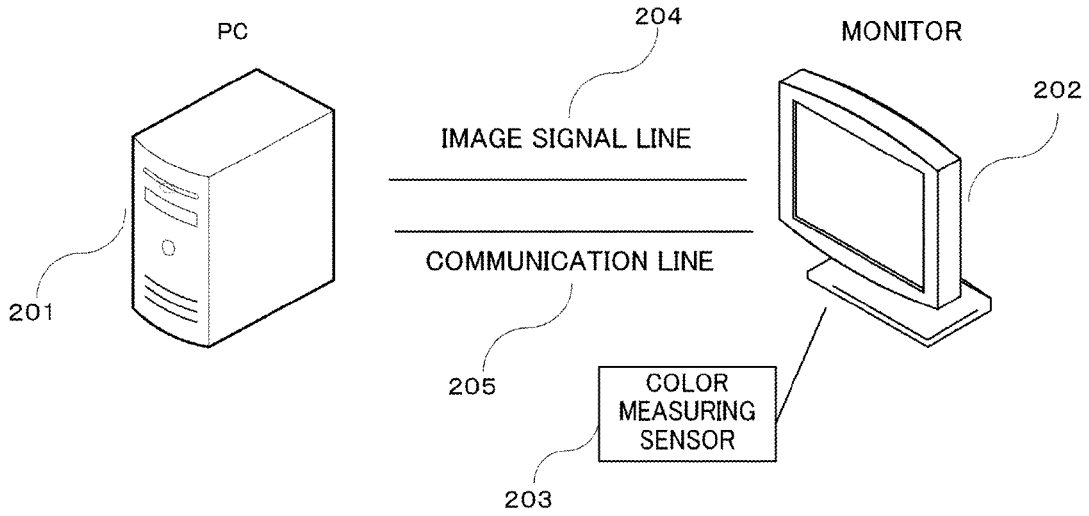
FIG. 2A and FIG. 2B show overall system arrangements according to a first embodiment.
Figure 2B:
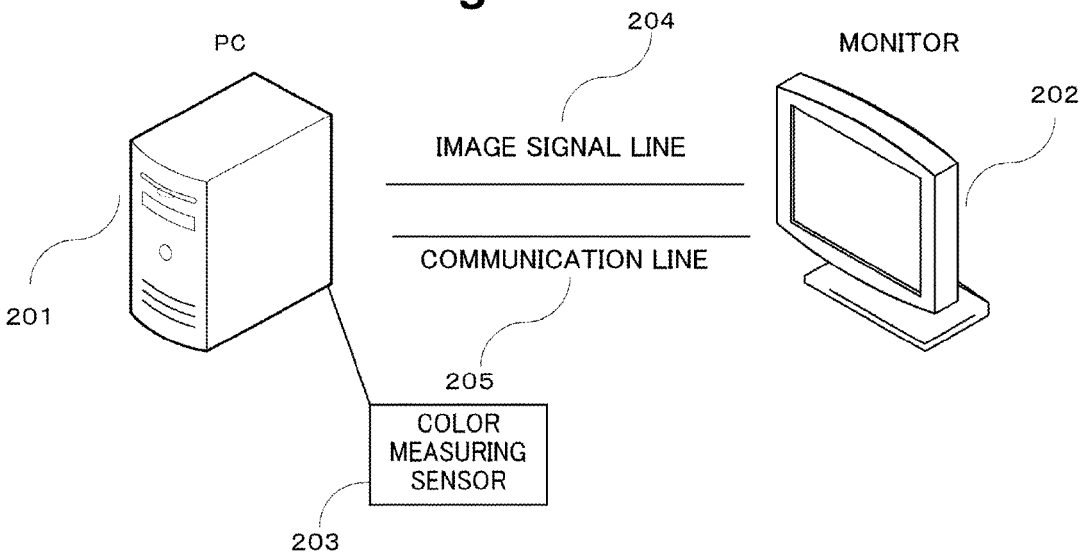

In this embodiment, an explanation will be made about an example in which the calibration is performed for a monitor by using an arrangement shown in FIG. 2A or FIG. 2B. This arrangement includes PC 201 which outputs an image signal and which is provided to operate an application in order to perform the calibration, a monitor 202 which is an image display apparatus as an adjustment object or target, and a color measuring sensor (colorimetric sensor) 203 which is provided to measure display colors of the monitor. This arrangement further includes a communication line 205 and an image output line 204 which are provided to transmit and receive the data between the application installed in PC 201 and the monitor 202 as the adjustment object or target. The color measuring sensor 203 may be connected to the monitor 202 as shown in FIG. 2A. Alternatively, the color measuring sensor 203 may be connected to PC 201 as shown in FIG. 2B. In the case of the arrangement shown in FIG. 2A, the color measuring sensor 203 transmits, to the monitor 202, the result of the measurement of the display colors of the monitor. In the case of the arrangement shown in FIG. 2B, the color measuring sensor 203 transmits, to PC 201, the result of the measurement of the display colors of the monitor.

<Explanation of System Arrangement to Realize this Embodiment>

An explanation will be made with reference to FIG. 3 about a system arrangement of a calibration control apparatus according to a first embodiment of the present invention.

An image signal is inputted from PC 201 into the monitor 202, and the inputted image signal is displayed on a display panel.

An image signal of a GUI image generated by a calibration application 301 is outputted by PC 201 by means of an image signal output unit 302.

The calibration application 301 acquires the data of, for example, calibration target values to be used, from a storage unit 303, and the data is stored and memorized in the storage unit 303 when the data is updated.

The calibration application 301 transmits the data to be used for the calibration for the monitor 202 to the monitor 202 via a communication control unit 304, the communication line 205, and a communication control unit 318. Similarly, the calibration application 301 receives the data processed, for example, by a calibration control unit 314 of the monitor 202 via the communication control unit 318, the communication line 205, and the communication control unit 304.

The calibration application 301 transmits the generated image signal such as the GUI image or the like to an image signal input unit 305 of the monitor 202 via the image signal output unit 302.

The image signal, which is generated by the calibration application 301 and which is outputted from PC 201, is inputted into the image signal input unit 305, and the image quality is adjusted in a display control unit 307 by the aid of an image quality adjusting unit 315. Further, the image signal, which is inputted into the image signal input unit 305, is combined (synthesized) with an OSD image generated by a GUI control unit 317 in the display control unit 307. The image signal, which has been subjected to the image quality adjustment and the combination (synthesis) with the OSD image, is transmitted to a display unit 308.

A backlight control unit 309 controls the light emission brightness (luminance) of a backlight 310 on the basis of the brightness (luminance) value set in the image quality adjusting unit 315.

An interface unit 313 receives a control signal corresponding to the operation of a user via a user interface including, for example, a remote controller and a main body buttons 319 for accepting the operation of the user. The interface unit 313 instructs the GUI control unit 317 to perform the generation of the GUI image and the action corresponding to the operation of the user, depending on the received control signal.

The GUI control unit 317 generates the GUI image data on the basis of the control signal received by the interface unit 313. In this arrangement, for example, any material data, which is required for the GUI image data, is acquired from a storage unit 311 included in the monitor 202. When the data is updated, the data is stored and memorized in the storage unit 311 in the same manner as described above.

The display control unit 307 combines (synthesizes) the input image inputted into the image signal input unit 305 and the GUI image generated by the GUI control unit 317, and the obtained image is outputted to the display unit 308.

The display unit 308 is constructed by a liquid crystal panel, and the display unit 308 displays the image based on the image signal outputted from the display control unit 307.

The backlight 310 is a module which irradiates the liquid crystal panel of the display unit 308. The light emission brightness is controlled for the backlight 310 on the basis of the brightness value determined by the backlight control unit 309.

A color measurement control unit 316 performs a series of control in relation to the color measurement (colorimetry) for the color measuring sensor 203 connected to the monitor 202, and the color measurement control unit 316 acquires the color measurement value. The color measurement control unit 316 stores the acquired color measurement value in the storage unit 311.

The calibration control unit 314 performs the calibration control in order to adjust the image quality of the monitor 202 on the basis of the calibration target value set with the calibration application 301 as described later on.

A verification control unit 306 performs the control to verify the image quality state of the monitor 202 on the basis of the result of the calibration performed by the calibration control unit 314 and the color patch designated with the calibration application 301 as described later on.

A system control unit 312 integrally performs the control for the respective functional units of the monitor 202.

<Explanation of Overall Flow to Realize this Embodiment>

Figure 4:
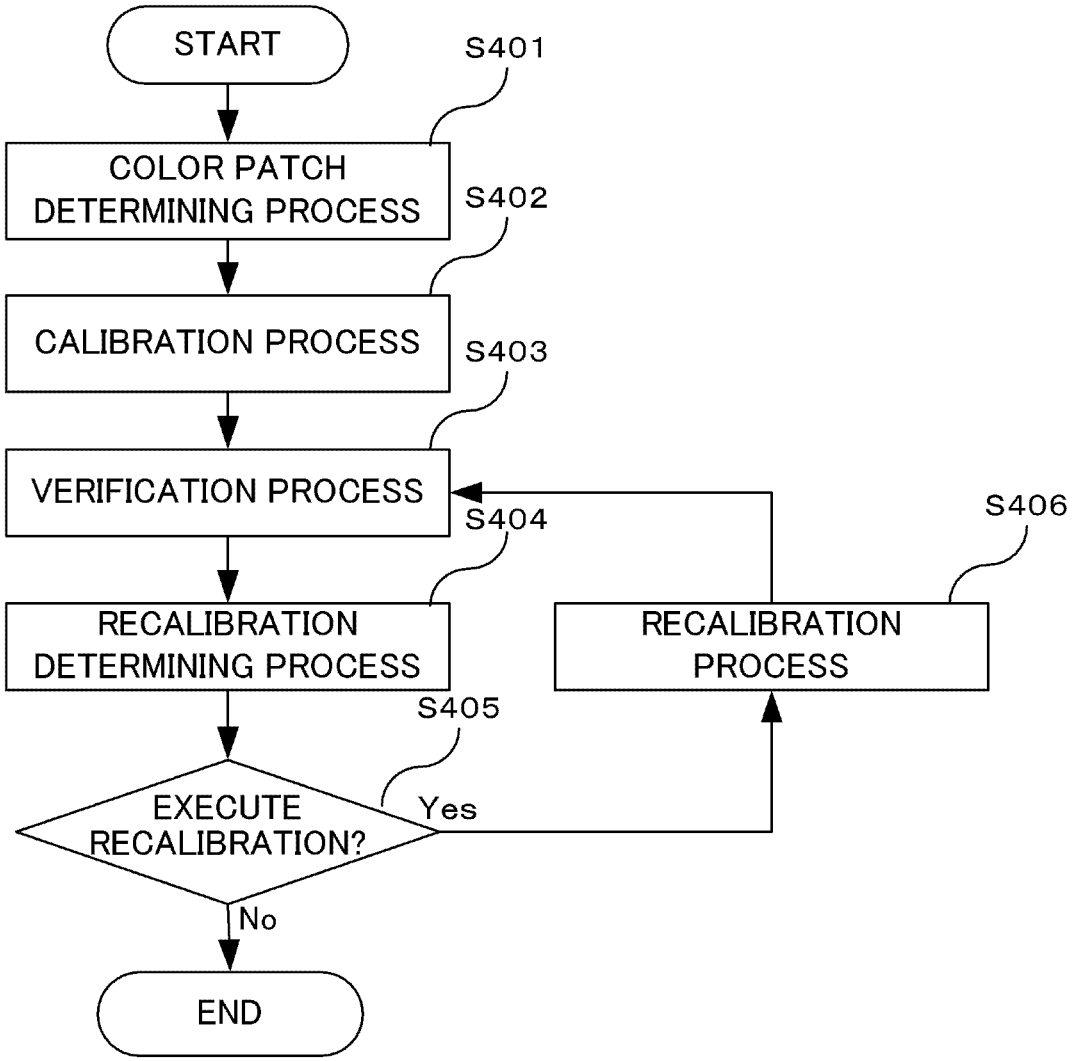
FIG. 4 shows a flow chart illustrating an overall process flow concerning the first embodiment.

An explanation will be made with reference to a flow chart shown in FIG. 4 about an overall process procedure in which the deviation direction and the deviation amount are calculated between the color measurement value after the calibration and the theoretical value thereof in relation to the color designated by the user, and the recalibration is performed.

The calibration application 301 displays a color patch determining image to prompt the user to designate the color patch, and the color patch to be used for the verification process is determined (Step S401).

The calibration application 301 determines the calibration target value and performs the initialization process for the color measuring sensor to be used, and the calibration application 301 executes the calibration (Step S402).

After the completion of the calibration process in S402, the calibration application 301 performs the color measurement for the plurality of color patches determined in S401 respectively, and the calibration application 301 executes the verification process to make comparison with respective theoretical values (Step S403).

The calibration application 301 calculates the deviation directions from the theoretical values of the color measurement values after the calibration for the respective color patches on the basis of the result verified in S403, and the calibration application 301 executes the determining process to determine whether or not the recalibration is performed (Step S404)

The calibration application 301 performs the control to decide whether the recalibration process is performed or the process is completed, on the basis of the result outputted in accordance with the recalibration determining process (Step S405).

If the determination result to execute the recalibration is outputted in accordance with the recalibration determining process in Step S404, the calibration application 301 performs the recalibration process (Step S406).

After the recalibration process in Step S406, the calibration application 301 executes the verification process in Step S403 and the recalibration determining process in Step S404.

The calibration application 301 repeats the processes as described above until the determination result not to execute the recalibration is outputted in accordance with the recalibration determining process in Step S404.

The processes, which correspond to Step S401, Step S402, Step S403, Step S404, and Step S406, will be explained in detail below.

<Explanation of Color Patch Determining Process (Step S401)>

An explanation will be made about the determining process for determining the color patch to be used for the determining process to determine whether or not the recalibration is performed. Reference is made to FIG. 5A, FIG. 5B, and FIG. 5C during the explanation.

In the color patch determining process, the calibration application 301 determines the color patch to be used for the determining process to determine whether or not the recalibration is performed. In this context, the color patch resides in a plurality of colors to be used in order that the measurement is performed to calculate the color reproduction accuracy of the calibration result and the determining process is performed to determine whether or not the recalibration is performed.

In this embodiment, in order to determine the color patch, the calibration application 301 displays color patch adding/registering screens 501, 502 as shown in FIG. 5A and FIG. 5B.

The calibration application 301 accepts the operation from the user by the aid of the displayed screens (GUI) 501, 502. The color patch, which is designated by the user operation, is added and registered to a color patch list which is a set of a plurality of color patches. The calibration application 301 stores the color patch list in the storage unit 303.

A plurality of types of color patch lists may be stored in the storage unit 303. The calibration application 301 displays a color patch list designating screen 503 as shown in FIG. 5C in order to allow the user to designate which color patch list is used for the verification process and the calibration determining process.

The calibration application 301 accepts the operation from the user by the aid of the displayed screen 503, and the color patch list to be used is determined.

The calibration application 301 transmits the determined color patch list data to the monitor 202 by the aid of the communication control unit 304. The color patch list data, which is transmitted to the monitor 202, is stored in the storage unit 311.

GUI's of the color patch adding screen 501, the color patch list screen 502, and the color patch list designating screen described above are referred to by way of example, and the present invention is not limited to these exemplary GUI's.

<Explanation of Calibration Process (Step S402)>

Figure 6:
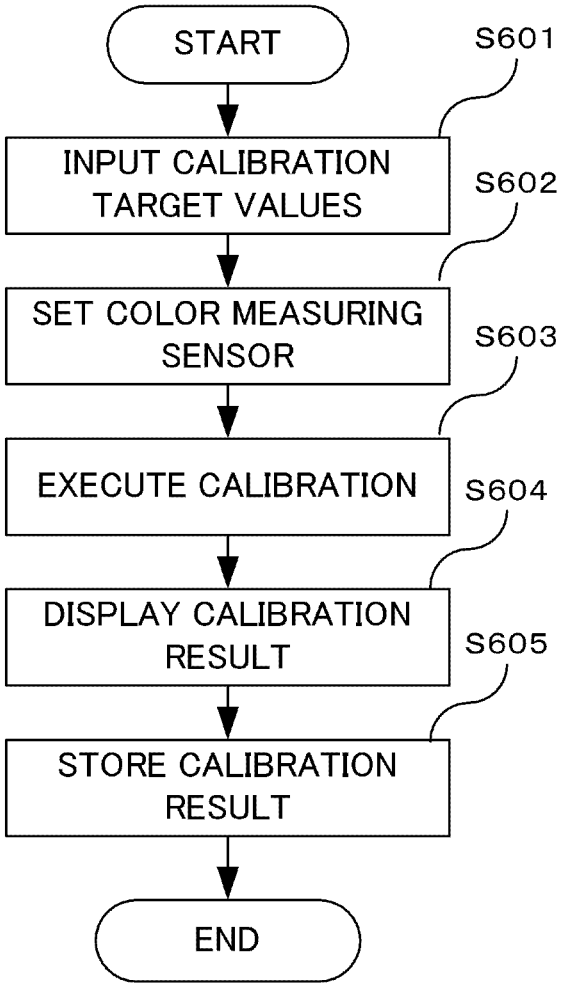
FIG. 6 shows a flow chart illustrating a calibration control process according to the first embodiment.
Figure 7:
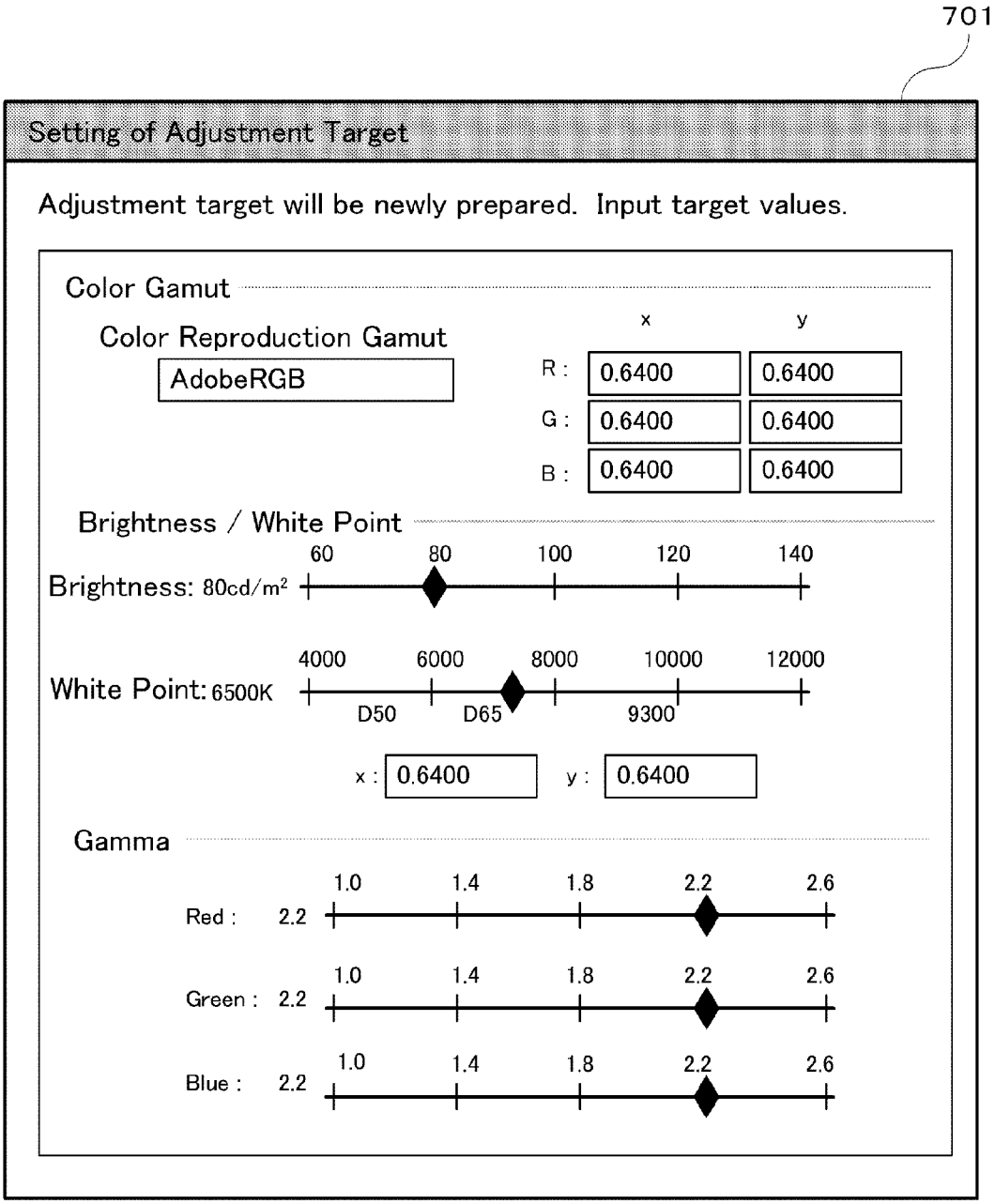
FIG. 7 shows a screen to input calibration target values according to the first embodiment.

An explanation will be made about the calibration process performed by PC 201 and the monitor 202. Reference is made to FIGS. 6, 7, and 8 during the explanation.

The calibration application 301 displays a calibration target value input screen 701 as shown in FIG. 7 (Step S601). The user inputs respective pieces of image quality data to serve as the target on the calibration target value input screen 701 so that the monitor 202 has an image quality conformed to the environment of use of the user. The image quality data to be inputted includes, for example, the color gamut, the brightness (luminance) and the white point (neutral point), and the gamma. The image quality data for inputting the target values is referred to by way of example, and there is no limitation thereto.

The calibration application 301 transmits the calibration target values set on the calibration target value input screen 701, to the calibration control unit 314 of the monitor 202 by the aid of the communication control unit 304. The calibration target values are stored in the storage unit 311 by means of the calibration control unit 314.

The calibration application 301 executes the initialization process for the color measuring sensor 203 connected to the monitor 202 by means of the color measurement control unit 316 (Step S602). The result of the executed initialization process is transmitted to the calibration control unit 314.

The calibration application 301 confirms that the result of the initialization process for the color measuring sensor 203 and the calibration target values set in S601 are normal, and the calibration application 301 executes the calibration (Step S603). The calibration is performed so that the image quality of the monitor 202 is coincident with the calibration target values set on the calibration target value input screen 701. Specifically, the calibration control unit 314 adjusts the image quality in cooperation with the image quality adjusting unit 315 so that the calibration target values are coincident with the measurement results on the basis of the measurement results of the colors and the brightness of the monitor 202 as obtained by the color measuring sensor 203.

The calibration application 301 acquires the calibration result data from the calibration control unit 314, and the calibration application 301 displays a calibration result display screen 801 as shown in FIG. 8 (Step S604). The contents to be displayed on the calibration result display screen 801 are, for example, the values which are set as the target on the calibration target value input screen 701 and the values which are obtained after the execution of the calibration.

The calibration application 301 stores the calibration result (Step S605). The result of the calibration is stored in the storage unit 303 as an ICC profile and a result file relevant to the calibration application 301, and the result is stored as image quality adjustment values in the storage unit 311 of the monitor 202.

According to the processes described above, the calibration application 301 adjusts (calibrates) the image quality of the monitor 202 so that the target values set by the user are provided.

<Explanation of Verification Process (Step S403)>

Figure 9:
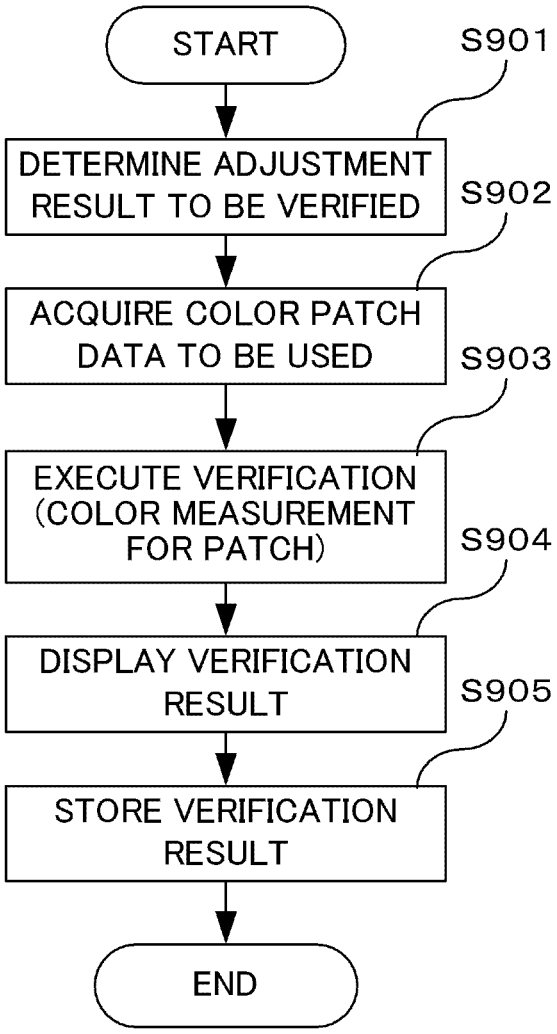
FIG. 9 shows a flow chart to explain a verification control process according to the first embodiment.

An explanation will be made about the verification process to confirm the degree or extent of conformity of the display state of the monitor with respect to the theoretical value, the calibration result being applied to the monitor. Reference is made to FIGS. 9 and 10 during the explanation.

The calibration application 301 determines the calibration result to be verified, in accordance with the designation by the user (Step S901). The calibration application 301 transmits the calibration result data which is the object of the verification as designated by the user, to the verification control unit 306 of the monitor 202 by the aid of the communication control unit 304. The calibration result data is stored in the storage unit 311 by means of the verification control unit 306.

The calibration application 301 acquires the color patch data which is to be used for the verification and which is stored in the storage unit 311, by the aid of the communication control unit 304 (Step S902).

The calibration application 301 confirms that the calibration result data determined in S901 and the color patch data acquired in S902 are normal, and then the calibration application 301 executes the verification process (Step S903). The calibration application 301 calculates and compares the result of the measurement of the color patch acquired as described above and the theoretical value thereof, in relation to the monitor 202 to which the calibration result designated by the user is applied, in cooperation with the verification control unit 306. Specifically, the calibration application 301 requires the acquisition of the result of the measurement of the color patch as measured by the color measuring sensor 203, with respect to the verification control unit 306, and the calibration application 301 acquires the result from the color measurement control unit 316. The calibration application 301 acquires, from the verification control unit 306, the acquired color measurement result of each of the color patches and the calibration result designated by the user, and the calibration application 301 calculates the theoretical value with respect to each of the respective color patches. The calibration application 301 calculates the color reproduction accuracy with respect to each of the color patches from the measured value of each of the color patches and the theoretical value thereof. The theoretical value and the measured value thereof and the color reproduction accuracy, which are calculated for each of the color patches, are stored in the storage unit 303.

The calibration application 301 displays the acquired and calculated verification result information (for example, color patch, and theoretical value, measured value, and color reproduction accuracy information of each color patch) as a verification result display screen 1001 as shown in FIG. 10 (Step S904). The user determines whether or not the color reproduction accuracy of the monitor 202 is satisfactory by viewing the data of each of the verification results displayed on the verification result display screen 1001.

The calibration application 301 performs the save process for the verification result (Step S905). The calibration application 301 stores the verification result data in the storage unit 303, and the calibration application 301 manages the data in correlation with the calibration result.

In accordance with the processes described above, the calibration application 301 executes the verification of the display state of the monitor 202 to which the designated calibration result is applied.

<Explanation of Recalibration Determining Process (Step S404)>

An explanation will be made about the process to determine whether or not the calibration is performed again, on the basis of the calibration result and the verification result. Reference is made to FIGS. 11, 12, 13, 14A and 14B during the explanation.

Figure 11:
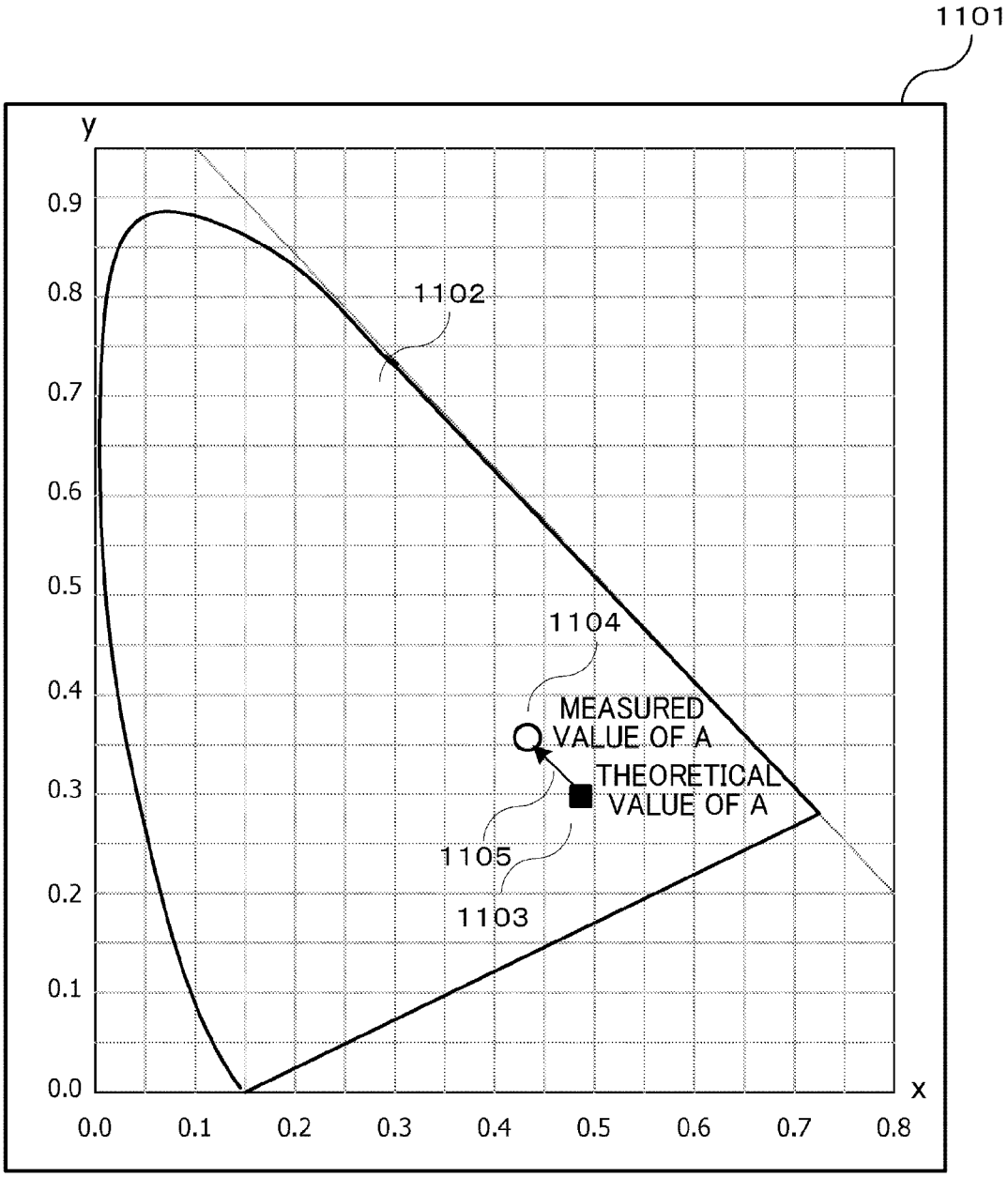
FIG. 11 shows a theoretical value and a color measurement value after the calibration of (one) color patch.

An explanation will be made with reference to FIG. 11 about the calculation of the deviation direction between the theoretical value of (one) color patch and the color measurement value after the calibration. A screen 1101 shown in FIG. 11 displays the theoretical value in relation to (one) color patch and the color measurement value after the calibration on the xy chromaticity diagram.

The calibration application 301 acquires the color measurement value 1104 of the color patch (referred to, for example, as "color patch A") and the calculated theoretical value 1103 of the color patch A from the verification result, and the calibration application 301 plots the color measurement value 1104 and the theoretical value 1103 on the xy chromaticity diagram (symbol or reference numeral: 1102).

The calibration application 301 calculates the vector 1105 which has the start point of the position of the theoretical value 1103 of the color patch A in the color space and the end point of the position of the color measurement value 1104 of the color patch A in the color space. In this procedure, the direction of the vector 1105 is the color deviation direction of the color patch A, and the length of the vector 1105 is the color deviation amount.

Figure 12:
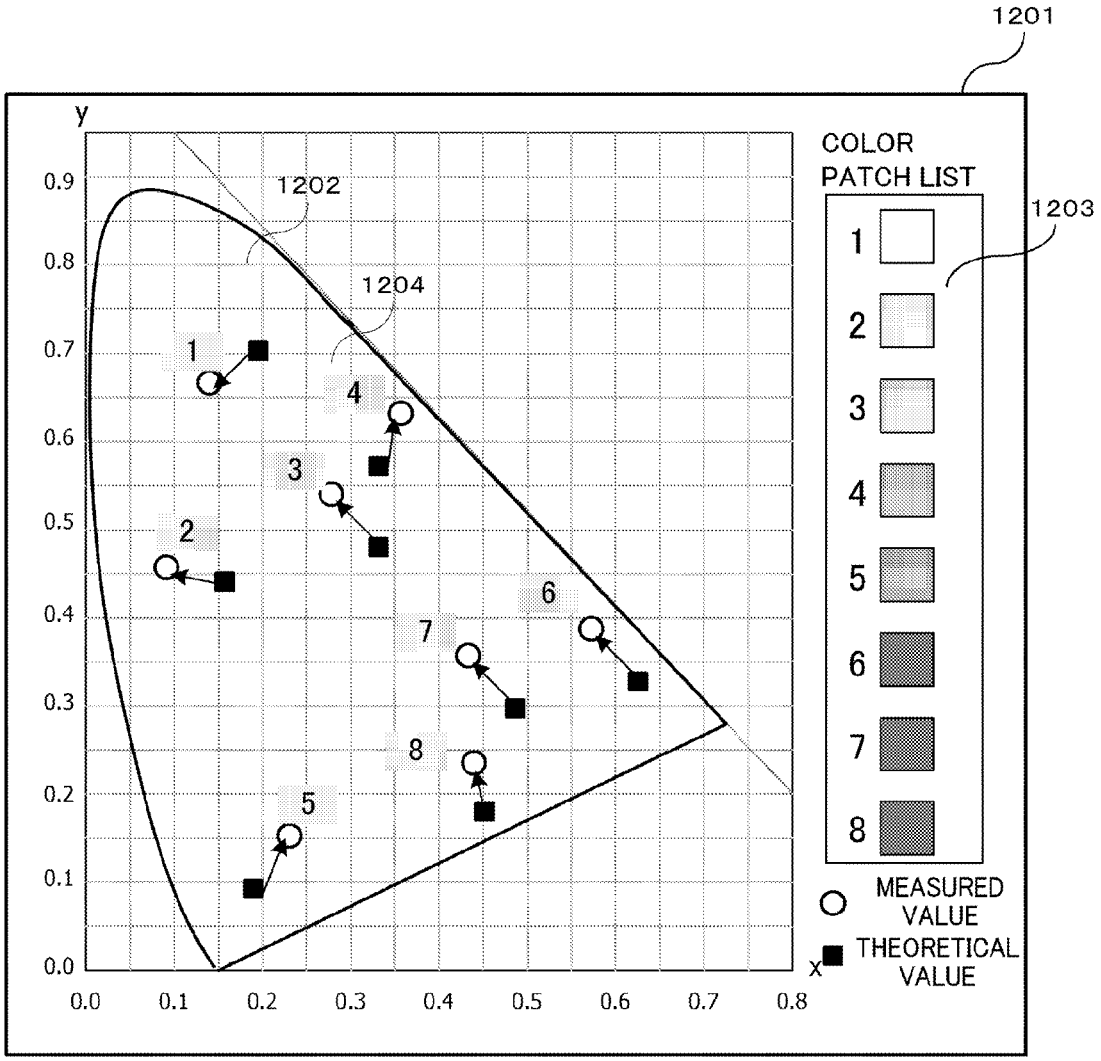
FIG. 12 shows theoretical values and color measurement values after the calibration of all color patches.

An explanation will be made with reference to FIG. 12 about the calculation of the deviation directions between the theoretical values of all of the color patches designated by the user and the color measurement values after the calibration. A screen 1201 shown in FIG. 12 displays the theoretical values in relation to all of the color patches designated by the user and the color measurement values after the calibration on the xy chromaticity diagram.

The calibration application 301 displays the plurality of color patches as a color patch list 1203 on the screen 1201. The calibration application 301 displays, in the color patch list 1203, rectangular icons based on respective display colors of the plurality of color patches and ID's thereof.

The calibration application 301 plots the color measurement values after the calibration and the theoretical values thereof with respect to the plurality of color patches respectively on the xy chromaticity diagram (symbol or reference numeral: 1202) on the screen 1201. The calibration application 301 displays the plot 1204 together with ID's in correlation with ID's corresponding to the respective color patches displayed in the color patch list 1203.

The calibration application 301 calculates the vector which has the start point of each of the theoretical values and the end point of the color measurement value corresponding thereto, in relation to each of the plurality of color patches. In this procedure, the direction of the vector is the color deviation direction of each of the color patches, and the length of the vector is the color deviation amount.

An explanation will be made with reference to FIG. 13 about the method for calculating the degrees of similarity of the deviation directions between the theoretical values of all of the color patches designated by the user and the color measurement values after the calibration.

Figure 13:
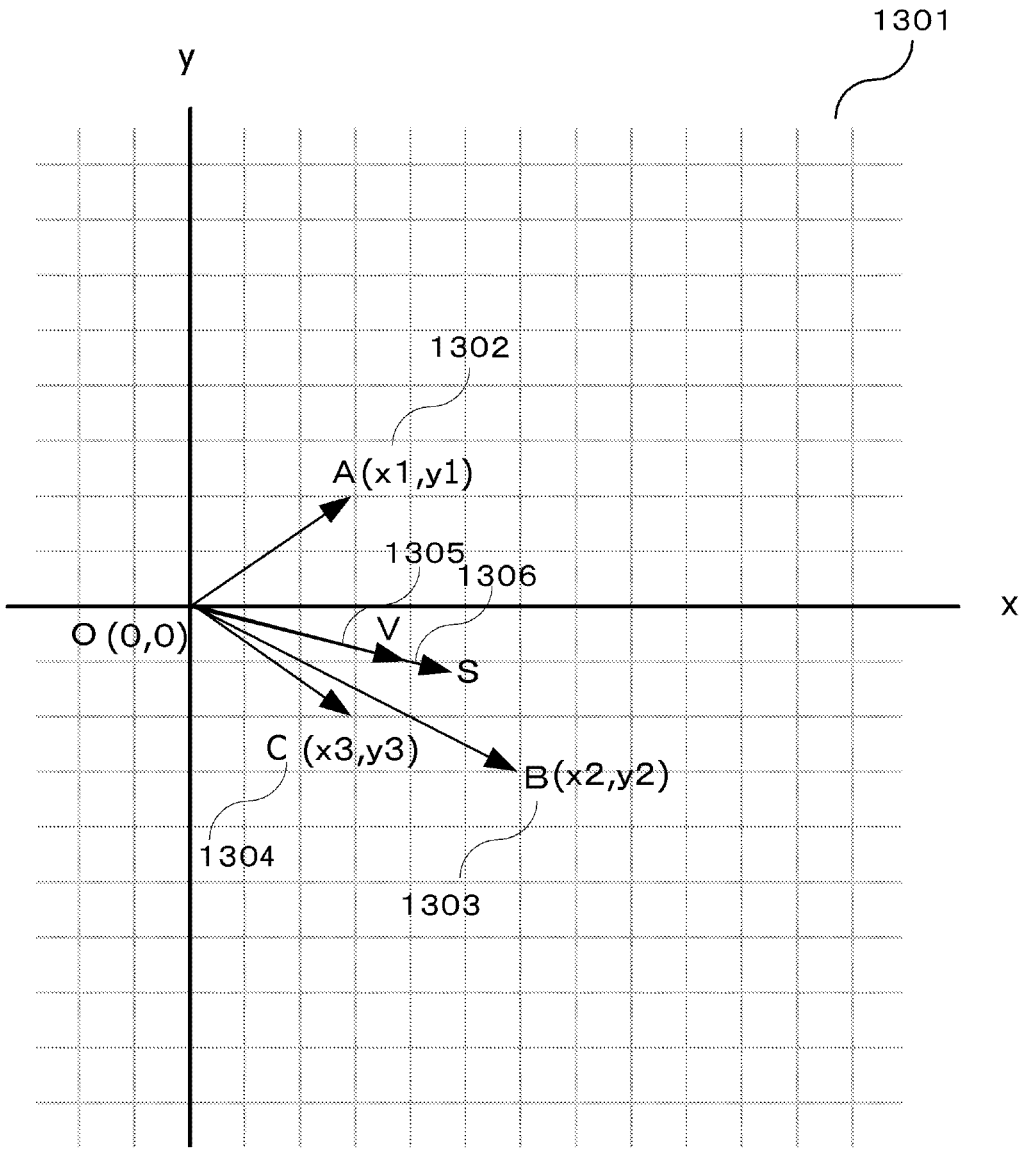
FIG. 13 shows a color measurement value after the calibration and a theoretical value of one color patch.

FIG. 13 shows, on the coordinate plane, the vectors which represent the directions and the magnitudes of the deviations in the color space, of the color measurement values after the calibration and the theoretical values thereof in relation to a plurality of color patches (three color patches are given in this case by way of example) as determined in accordance with the color patch determining process.

The color deviation directions (vectors), which relate to the three color patches, are designated as A (x1, y1) 1302, B (x2, y2) 1303, and C (x3, y3) 1304 respectively on the basis of the origin on the xy coordinates.

The calibration application 301 compares the length V of the average vector obtained by averaging the color deviation direction vectors of all of the color patches with the average S of the lengths of all of the color deviation direction vectors. In this procedure, assuming that n represents the number of color patches, and V1, V2, . . . , Vn represent the color deviation direction vectors, the following expressions are given:

$$V = \left| \frac{\vec{V}_1 + \vec{V}_2 + \ldots + \vec{V}_n}{n} \right|$$

$$S = \frac{\left|\vec{V}_1\right| + \left|\vec{V}_2\right| + \ldots + \left|\vec{V}_n\right|}{n}$$

V≤S holds, wherein the equal sign holds if the orientations (directions) of all of the color deviation direction vectors V1, V2, . . . , Vn are identical. In this embodiment, the degree of similarity determination coefficient C is defined as C=V/S. The calibration application 301 determines whether or not the execution of the recalibration process is required on the basis of the comparison between the degree of similarity determination coefficient C and a threshold value.

There is given 0≤C≤1. The more approximate to one another the orientations of n individuals of the color deviation direction vectors are, the more approximate to 1 the value of the degree of similarity determination coefficient C is.

When the orientations of n individuals of the color deviation direction vectors are approximate to one another, if the calibration is performed again by using the values obtained by subtracting the orientations and the magnitudes of the deviations from the calibration target values as new calibration target values, then it is expected that the color measurement values of the respective color patches approach the theoretical values. However, when the orientations of n individuals of the color deviation direction vectors are not aligned, it is considered that the state of the image quality of the monitor is not greatly improved, even if the calibration is executed again. Therefore, the merit, which would be obtained by executing the calibration again, is small.

Therefore, in this embodiment, the threshold value TH (0<TH<1) is decided. If the degree of similarity determination coefficient C is larger than the threshold value TH, the calibration application 301 determines that the calibration is to be executed again, because the orientations of the color deviation direction vectors are aligned. On the other hand, if the degree of similarity determination coefficient C is not more than the threshold value TH, the calibration application 301 determines that the calibration is not to be executed again, because the orientations of the color deviation direction vectors are not aligned. For example, the threshold value TH is set to 0.7. The threshold value TH can be set by the user, or the threshold value TH may be previously determined by the calibration application 301. If the values of V and S are sufficiently small when the degree of similarity determination coefficient C is larger than the threshold value TH, then it is considered that the state of the image quality of the monitor is a sufficiently satisfactory state even when the calibration is not performed again. Therefore, it is also allowable that the calibration is not performed again if the values of V and S are smaller than preset threshold values.

In FIG. 13, V (x_ave, y_ave) 1305 represents the average vector of the color deviation direction vectors A, B, C of all of the color patches. The length of the average vector V (x_ave, y_ave) 1305 is as follows:

$$|V| = ((x_ave)^2 + (y_ave)^2)^{1/2} = (((x1+x2+x3)/3)^2 + ((y1+y2+y3)/3)^2)^{1/2}$$

The average S of the magnitudes |A|, |B|, |C| of all of the color deviation direction vectors is as follows.

$$S = (((x1)^2 + (y1)^2)^{1/2} + ((x2)^2 + (y2)^2)^{1/2} + ((x3)^2 + (y3)^2)^{1/2})/3$$

In FIG. 13, the vector, which has the same orientation as that of the average vector V and which has the length of S, is shown by the symbol or reference numeral 1306 for the purpose of comparison.

In accordance with the processes described above, the calibration application 301 calculates the degrees of similarity of the deviation directions between the color measurement values after the calibration and the theoretical values thereof in relation to the plurality of designated color patches, and the calibration application 301 determines whether or not the recalibration is performed.

The calibration application 301 calculates the degree of similarity determination coefficient in accordance with the calculation described above, and the calibration application 301 compares the obtained result with the threshold value. If it is determined that the degree of similarity is high, it is determined that the calibration is performed again. If it is not determined that the degree of similarity is high, the process comes to an end.

Figure 14A:
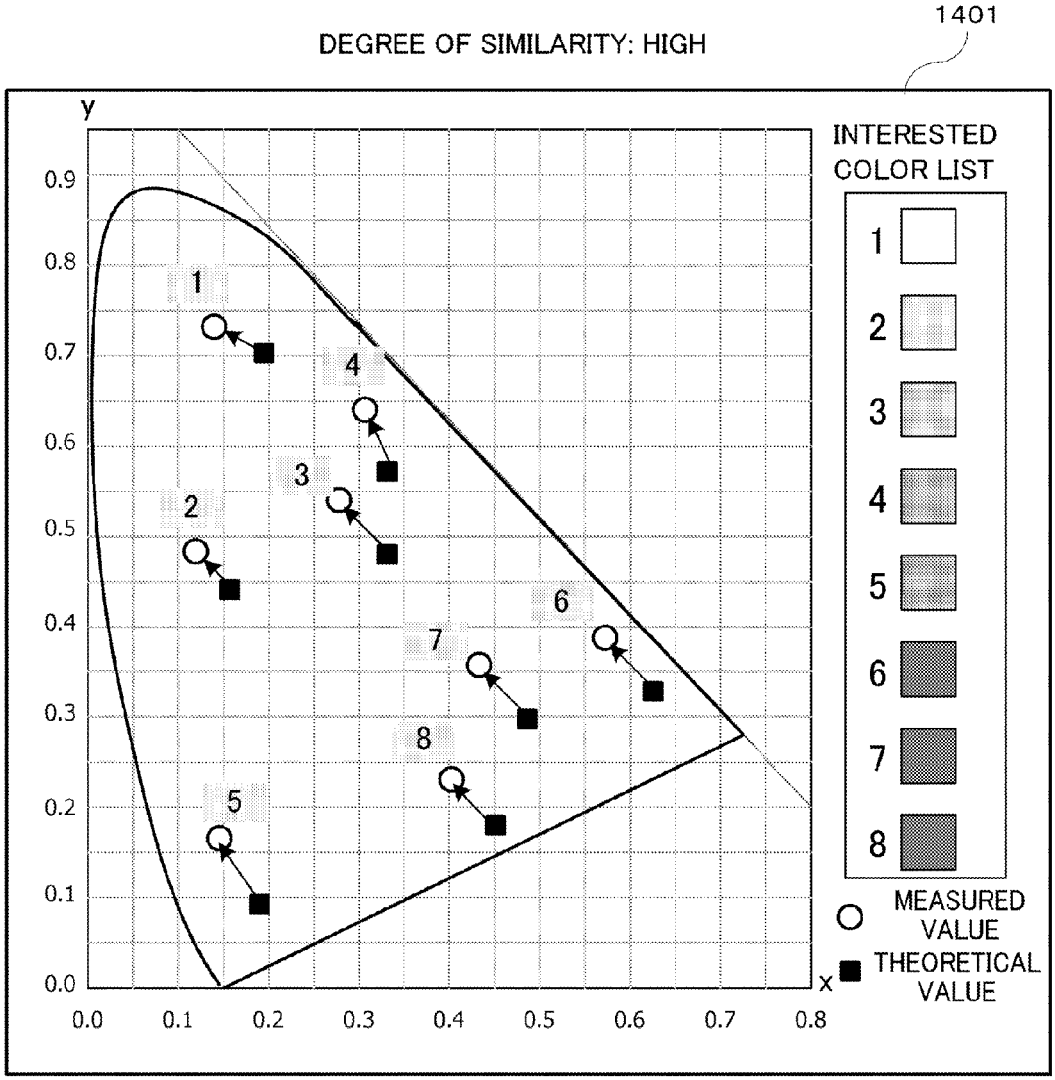
FIG. 14A and FIG. 14B show color measurement values after the calibration and theoretical values of a plurality of color patches.
Figure 14B:
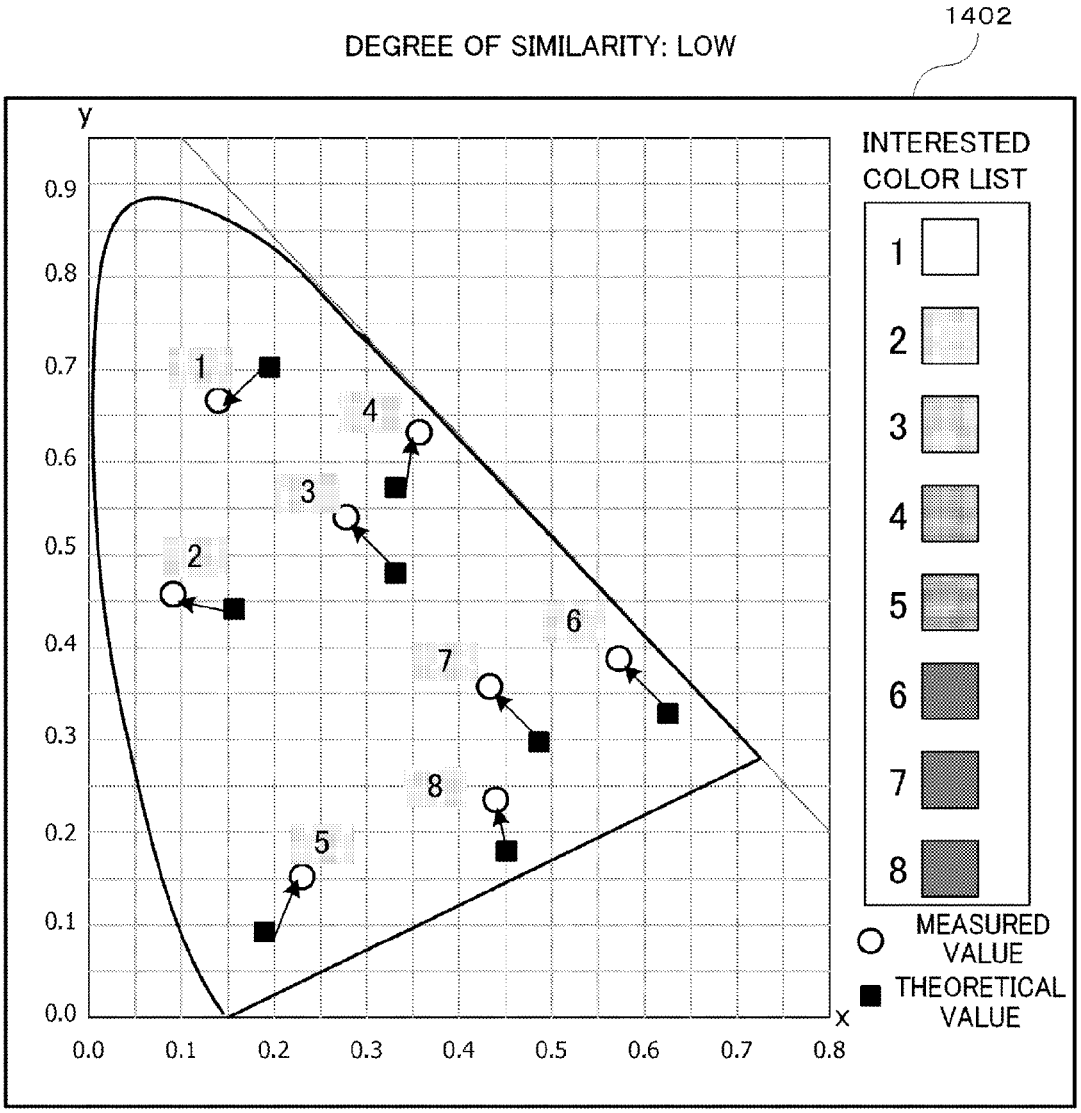

FIG. 14A shows, with a symbol or reference numeral 1401, the chromaticity diagram as provided when the degrees of similarity of the deviation directions between the color measurement values after the calibration and the theoretical values thereof are high in relation to the plurality of designated color patches. FIG. 14B shows, with a symbol or reference numeral 1402, the chromaticity diagram as provided when the degrees of similarity are low.

The process for determining the recalibration may be performed in accordance with any other method (for example, the degrees of similarity of a plurality of color patches are calculated on the basis of the angles).

<Explanation of Recalibration Process (Step S406)>

Figure 15:
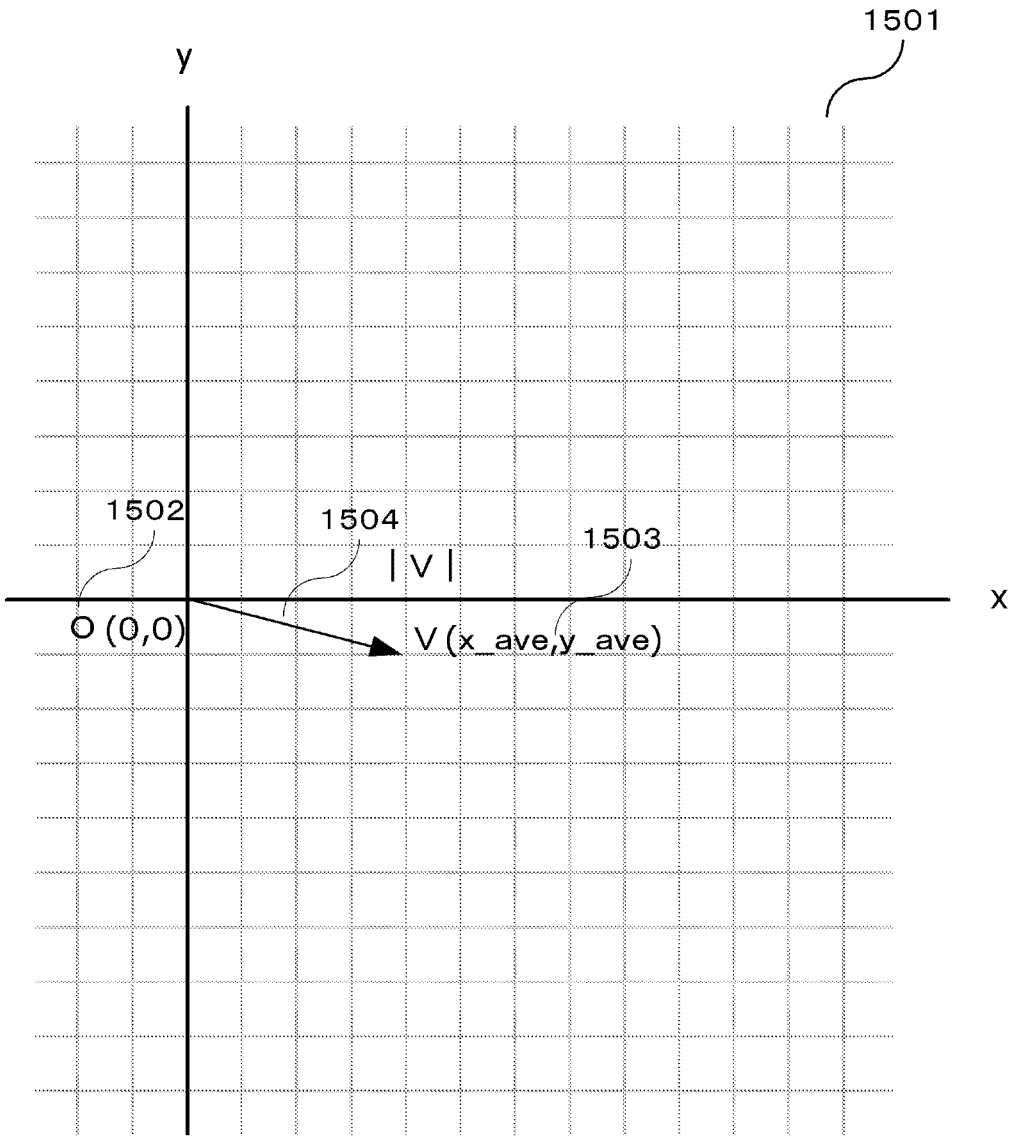
FIG. 15 shows a deviation amount between a color measurement value after the calibration and a theoretical value of one color patch.

An explanation will be made about the recalibration process in which the deviations of the plurality of color patches are taken into consideration, the recalibration process being performed after the execution of the process for determining whether or not the calibration is performed again as described above. Reference is made to FIG. 15 during the explanation.

An explanation will be made with reference to FIG. 15 about the method for calculating the average value of the deviation amounts between the color measurement values after the calibration and the theoretical values thereof in relation to a plurality of color patches. FIG. 15 shows the average deviation direction vector between the color measurement values after the calibration and the theoretical values thereof in relation to the plurality of designated color patches.

The calibration application 301 calculates the deviation amount average value |V| 1504 and the x, y coordinate component V (x_ave, y_ave) 1503 of the average deviation direction vector in which the origin O (0, 0) 1502 is the start point, in relation to the plurality of designated color patches.

The calibration application 301 acquires the target values (color gamut coordinates) used upon the execution of the previous calibration. The calibration application 301 subtracts V (x_ave, y_ave) 1503 from the acquired target values (color gamut coordinates) to adjust the target values.

The calibration application 301 transmits the adjusted target values (color gamut coordinates) as new target values to the calibration control unit 314.

The calibration control unit 314 performs the calibration process on the basis of the received new target values.

In accordance with the processes described above, the calibration application 301 executes the recalibration process while taking the deviations of the plurality of color patches into consideration.

Figure 16:
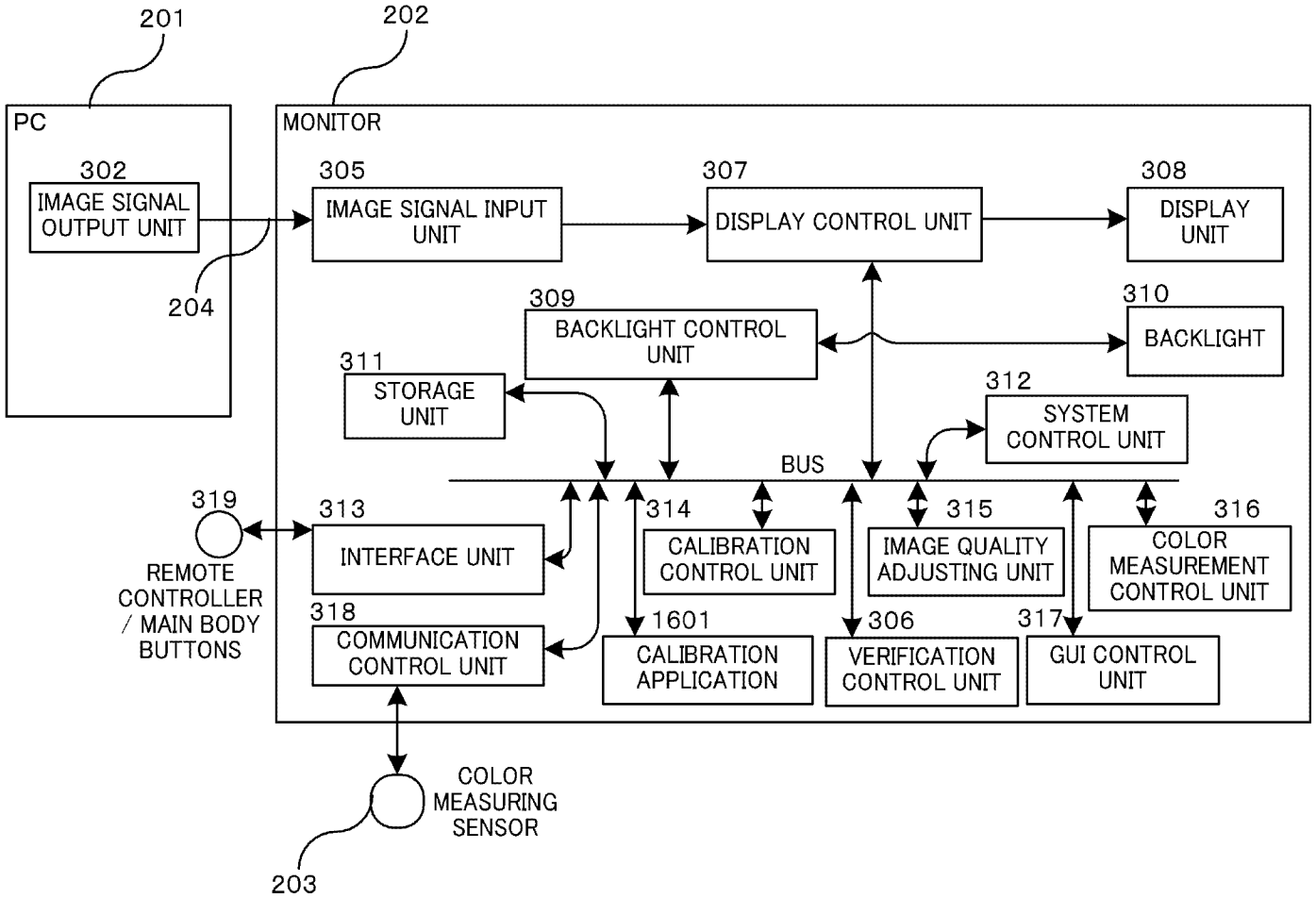
FIG. 16 shows a block diagram illustrating another system arrangement according to the first embodiment.

The processes according to the first embodiment of the present invention described above can be also performed by using a system arrangement in which a calibration application 1601 is included in the monitor 202 as shown in FIG. 16.

(Second Embodiment)

Figure 17:
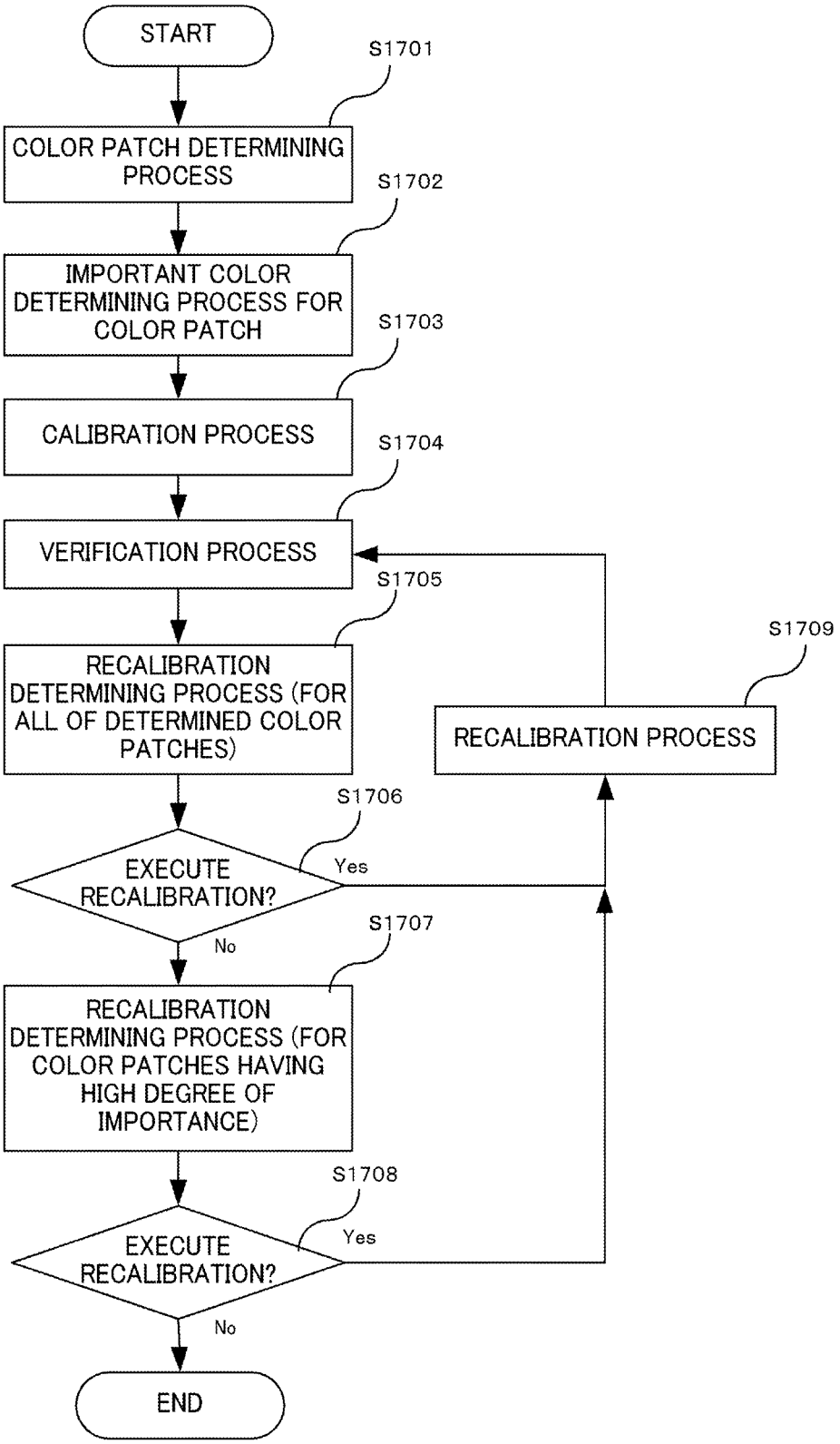
FIG. 17 shows a flow chart illustrating a recalibration process according to a second embodiment.
Figure 18:
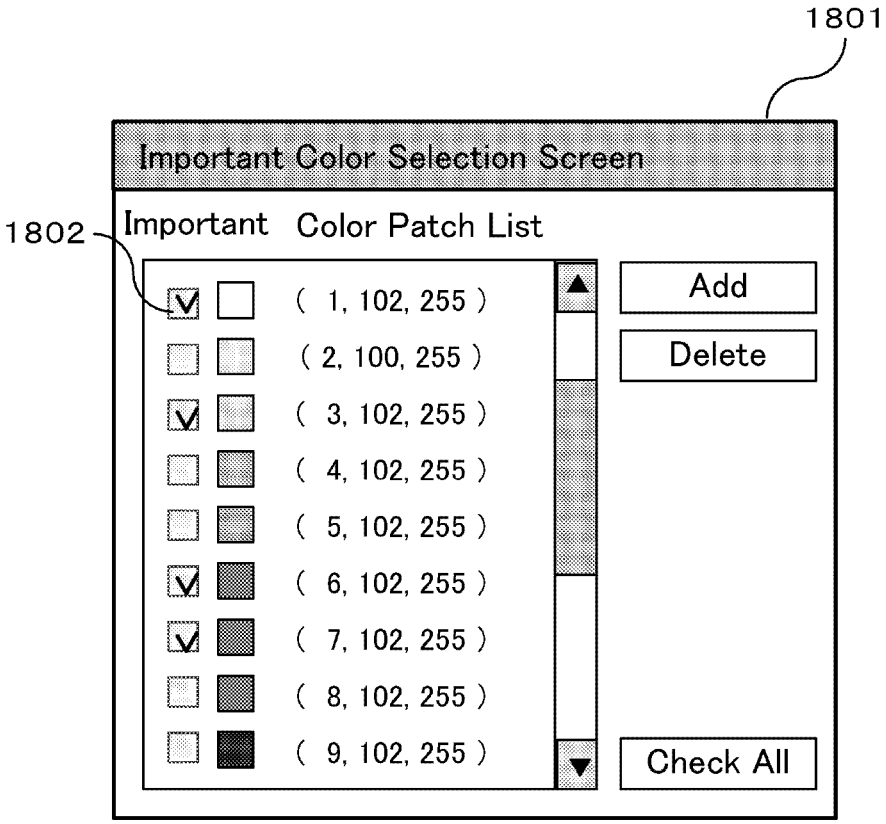
FIG. 18 shows a screen to set the degree of importance of any color patch before the calibration.
Figure 19:
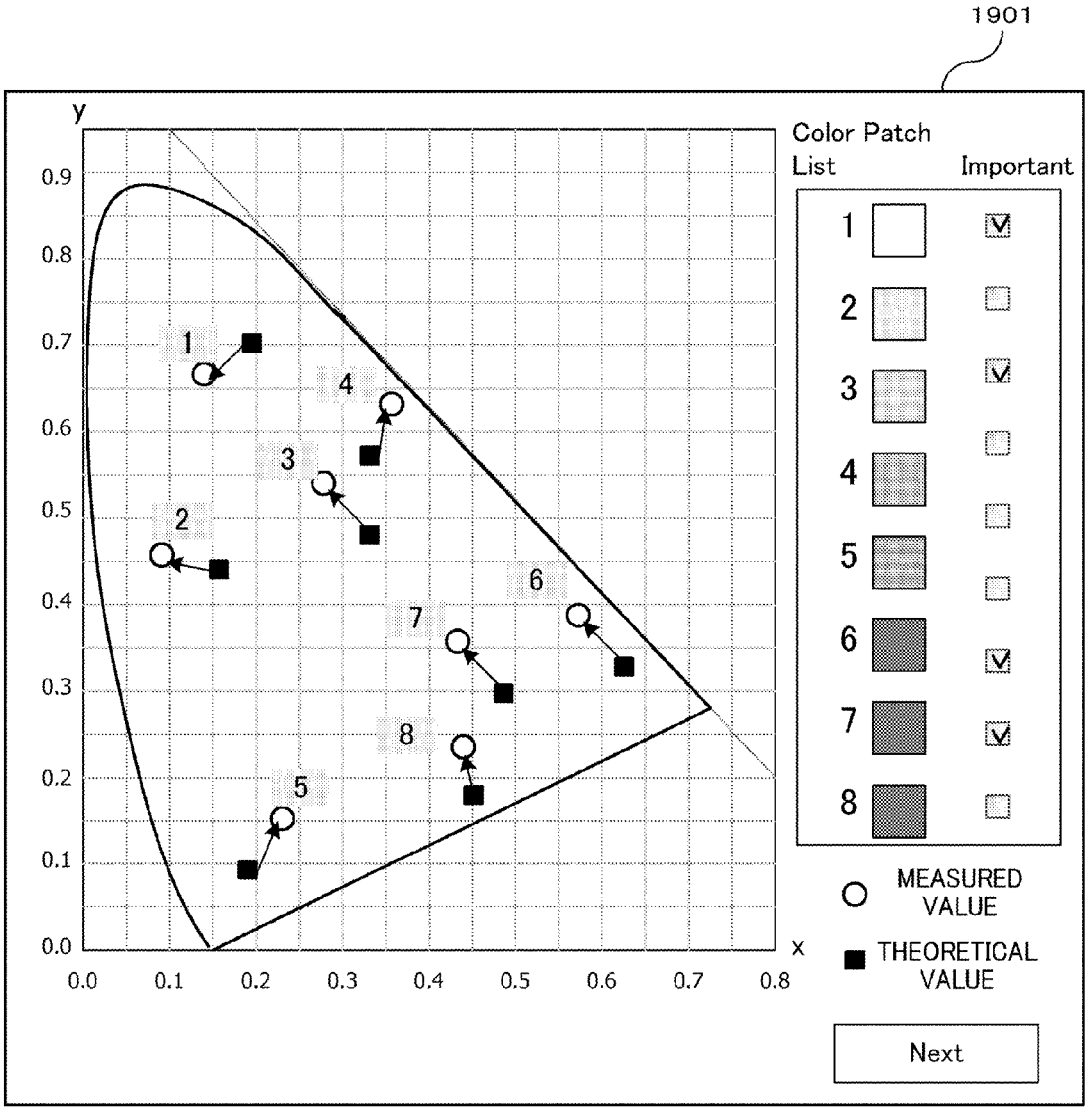
FIG. 19 shows a screen to set the degree of importance of any color patch after the calibration.

In the first embodiment, the degrees of similarity of the deviation directions between the color measurement values after the calibration and the theoretical values have been determined by using all of the plurality of color patches designated by the user. In this embodiment, some of color patches, which are included in a plurality of color patches designated by the user, are determined as preferential color patches (color patches having the high degree of importance). The color patches are used to determine the degrees of similarity of the deviation directions between the color measurement values after the calibration and the theoretical values. An explanation will be made about the calibration control process to determine whether or not the calibration is performed again. PC and the monitor are constructed in the same manner as in the first embodiment. Reference is made to FIGS. 17, 18, and 19 during the explanation.

The calibration application 301 performs the color patch determining process in the same manner as in the first embodiment (Step S1701).

The calibration application 301 displays, for example, GUI (important color selection screen 1801) as shown in FIG. 18 so that the colors having the high degree of importance (important colors) can be selected in relation to the color patches determined by the user, and the calibration application 301 performs an important color determining process (Step S1702). The user checks the important color patch check box 1802 for the color patch having the high degree of importance, of the color patch list designated in S1701 and displayed on the important color selection screen 1801. The calibration application 301 stores, in the storage unit 303, the information (important color information) of the colors checked by the user in the important color patch check boxes 1802 in correlation with the color patch list.

The calibration application 301 executes the calibration process in the same manner as in the first embodiment (Step S1703).

The calibration application 301 executes the verification process in the same manner as in the first embodiment (Step S1704).

The calibration application 301 performs the recalibration determining process for all of the color patches determined as described above in the same manner as in the first embodiment (Step S1705). That is, the calibration application 301 calculates the degree of similarity determination coefficient (first determination coefficient) for the orientations of the color deviation vectors in relation to all of the color patches, and the degree of similarity determination coefficient (first determination coefficient) is compared with a threshold value.

If the result is given to perform the recalibration in accordance with the determining process, i.e., if the first determination coefficient is larger than the threshold value (Step S1706: Yes), then the calibration application 301 performs the recalibration process (Step S1709) in the same manner as in the first embodiment.

If the result is given not to perform the recalibration in accordance with the determining process, i.e., if the first determination coefficient is not larger than the threshold value (Step S1706: No), then the calibration application 301 performs the following process. That is, the recalibration determining process is performed for the color patch determined as the color having the high degree of importance (Step S1707). The calibration application 301 calculates the degree of similarity determination coefficient (second determination coefficient) for the orientations of the color deviation vectors in relation to the color patches having the high degree of importance, and the degree of similarity determination coefficient (second determination coefficient) is compared with a threshold value.

If the result is given to perform the recalibration in relation to the color patches having the high degree of importance in accordance with the determining process, i.e., if the second determination coefficient is larger than the threshold value (Step S1708: Yes), then the calibration application 301 performs the following process. That is, the recalibration process (Step S1709) is performed. In this procedure, the deviation amount average value, which is used to calculate a new target value in the recalibration process, is calculated from the deviation amounts for the color patches having the high degree of importance.

If the result is given not to perform the recalibration in relation to the color patches having the high degree of importance in accordance with the determining process described above, i.e., if the second determination coefficient is not larger than the threshold value (Step S1708: No), then the calibration application 301 completes the process.

In accordance with the processes described above, the calibration application 301 determines the color patches having the high degree of importance. Accordingly, the calibration application 301 performs the calibration control process to determine whether or not the calibration is performed again on the basis of the degrees of similarity of the color deviation directions.

In relation to the calibration control process described above, it is also allowable that the process for determining the color patches having the high degree of importance is not performed before the calibration process. Specifically, if it is determined in Step S1706 shown in FIG. 17 that the recalibration is not performed (if the degrees of similarity of the deviation directions of (all of) the designated color patches are low), for example, GUI (important color selection screen 1901) is displayed as shown in FIG. 19.

The user checks the check boxes for the color patches having the high degree of importance in the designated color patch list displayed on the important color selection screen 1901.

After the important colors are determined by the aid of GUI shown in FIG. 19, the calibration application 301 performs the recalibration determining process of Step S1707 shown in FIG. 17. After that, the calibration application 301 performs the processes which are the same as or equivalent to those explained above.

In accordance with the processes described above, even when the color having the high degree of importance is determined after the calibration, the calibration application 301 can perform the calibration control process to determine whether or not the calibration is performed again on the basis of the deviation amount of the important color.

(Third Embodiment)

This embodiment is a modified embodiment of the first embodiment, wherein a screen is displayed to inquire of the user about whether or not the recalibration is performed in relation to designated color patches after it is determined whether or not the recalibration is required (adequate) in relation to the designated color patches.

Figure 20:
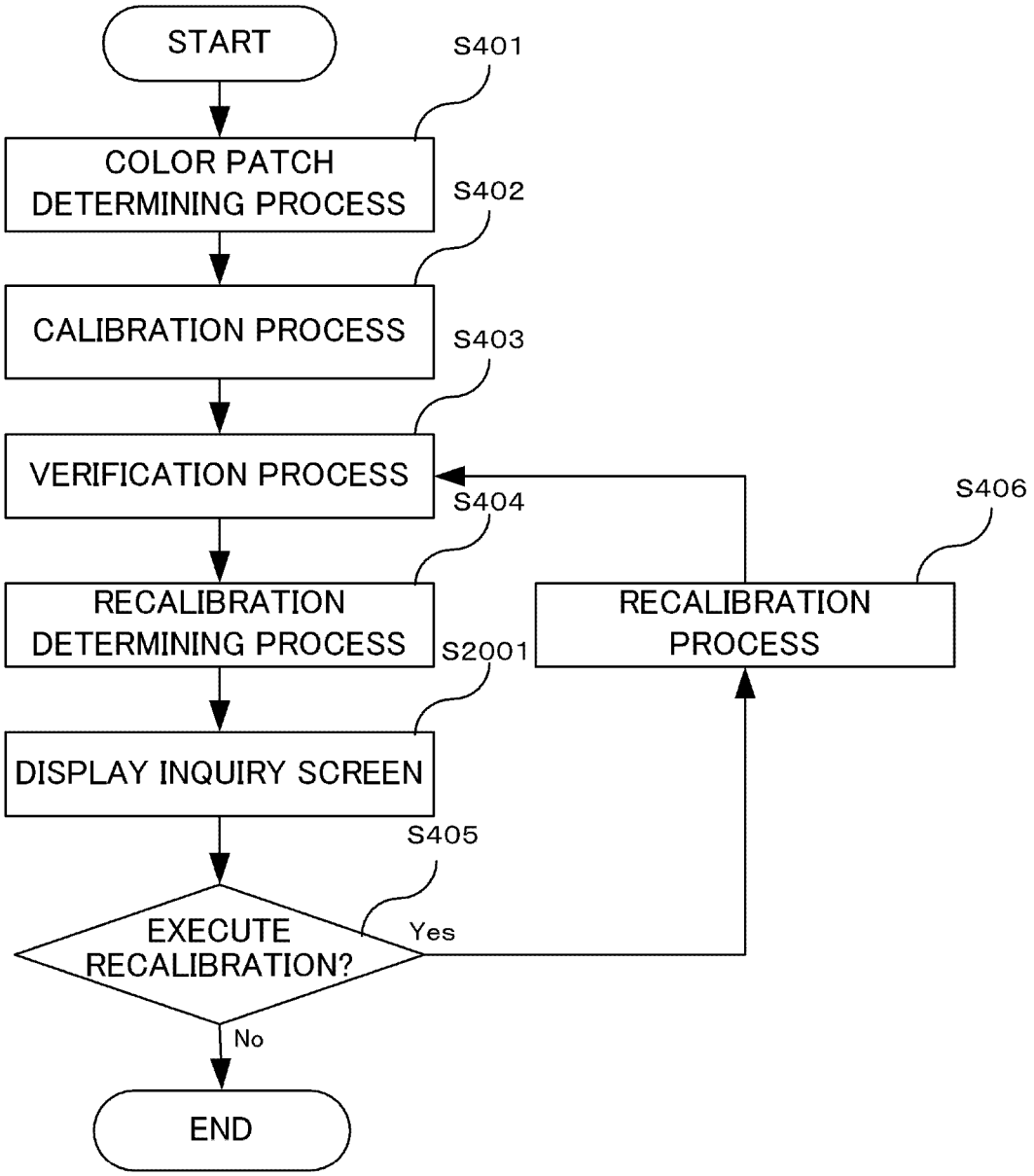
FIG. 20 shows a flow chart illustrating an overall process flow according to a third embodiment.

FIG. 20 shows a flow chart illustrating an overall process flow according to the third embodiment. FIG. 20 is different from FIG. 4 of the first embodiment in that Step S2001 is added. After the recalibration determining process is performed in Step S404, the screen is displayed in Step S2001 to inquire of the user about whether or not the recalibration is performed in relation to the designated color patches.

Figure 21A:
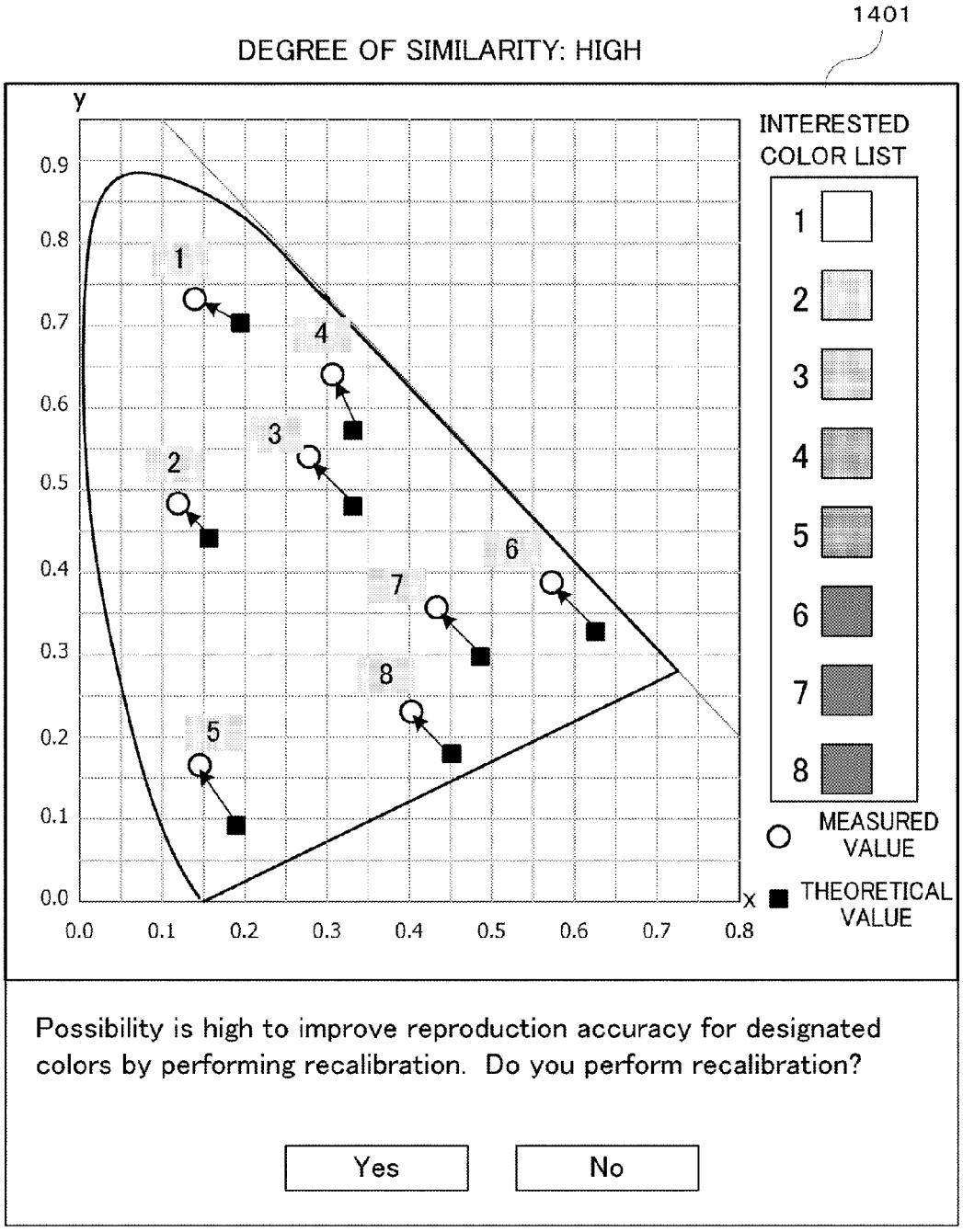
FIG. 21A and FIG. 21B show recalibration inquiry screens in relation to a plurality of designated color patches.
Figure 21B:
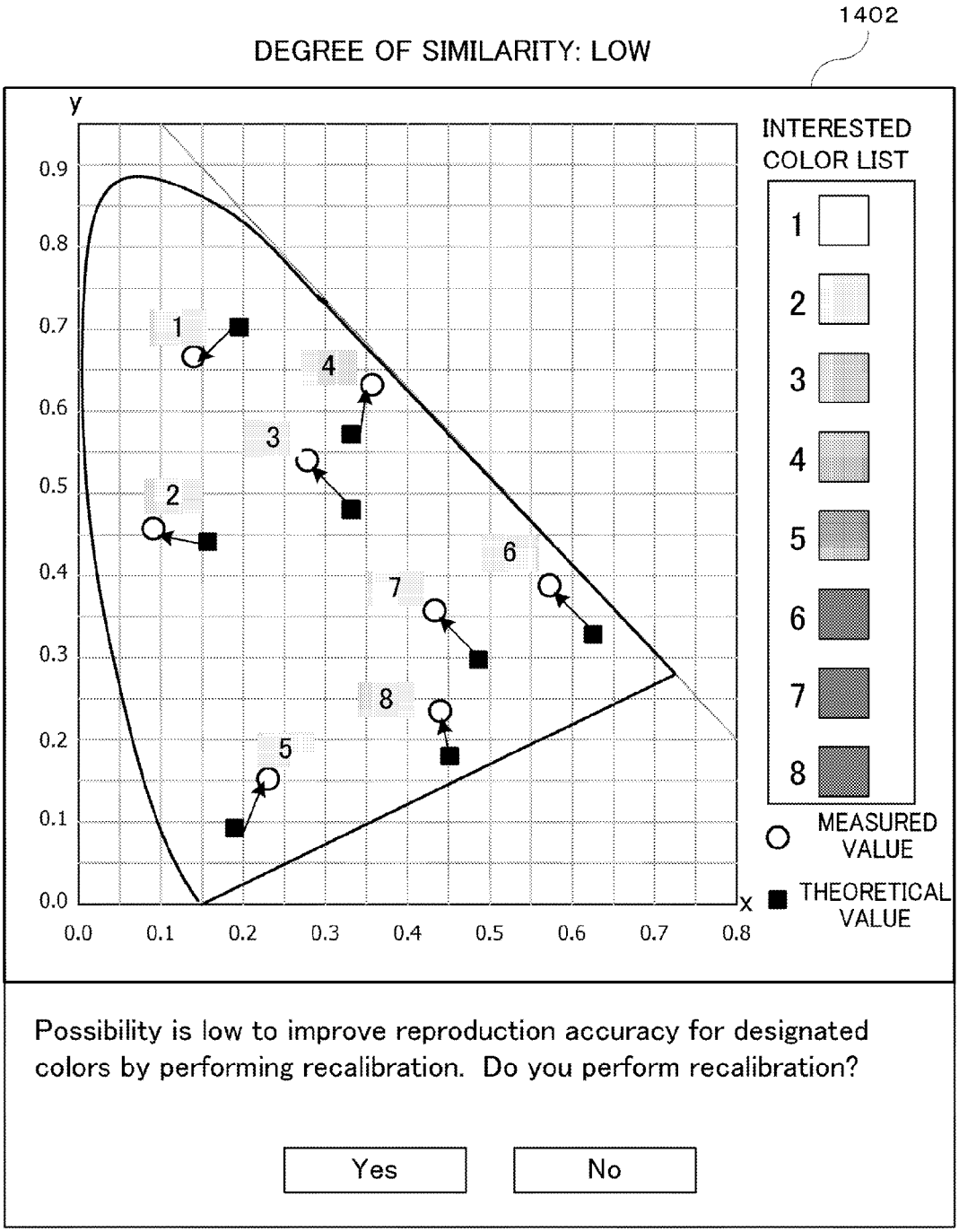

FIGS. 21A and 21B show recalibration inquiry screens in relation to a plurality of designated color patches. FIG. 21A shows an exemplary inquiry screen provided when it is determined that the execution of the recalibration is adequate in relation to the plurality of designated color patches. In the case of this inquiry screen, a message of "Possibility is high to improve color reproduction accuracy for designated colors by performing recalibration. Do you perform recalibration?" is displayed.

On the other hand, FIG. 21B shows an exemplary inquiry screen provided when it is determined that the execution of the recalibration is not adequate in relation to the plurality of designated color patches. In the case of this inquiry screen, a message of "Possibility is low to improve color reproduction accuracy for designated colors by performing recalibration. Do you perform recalibration?" is displayed. The inquiry screens are generated by the calibration application 301 shown in FIG. 3 or the calibration application 1601 shown in FIG. 16.

If the user selects "YES" on the inquiry screen, it is subsequently determined in Step S405 that the recalibration is executed. If the user selects "NO", the process comes to an end. According to this embodiment, the convenience is further improved for the user.

(Fourth Embodiment)

This embodiment is a modified embodiment of the second embodiment, wherein a screen is displayed to inquire of the user about whether or not the recalibration is performed in relation to all of the color patches after it is determined whether or not the recalibration is required (adequate) in relation to all of the color patches. Further, a screen is displayed to inquire of the user about whether or not the recalibration is performed in relation to the color patches having the high degree of importance after it is determined whether or not the recalibration is required (adequate) in relation to the color patches having the high degree of importance.

Figure 22:
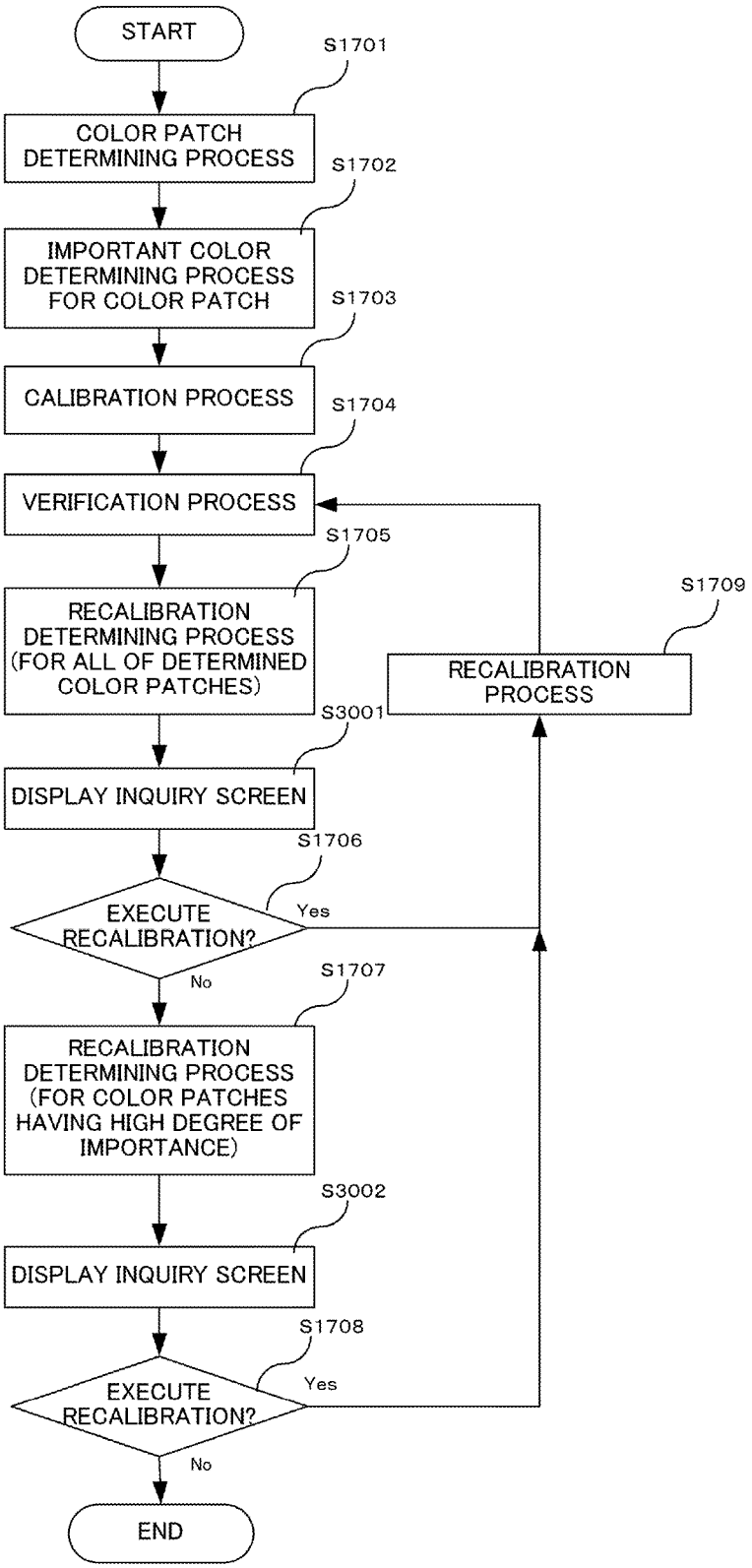
FIG. 22 shows a flow chart illustrating a recalibration process according to a fourth embodiment.

FIG. 22 shows a flow chart illustrating the recalibration process according to the fourth embodiment. FIG. 22 is different from FIG. 17 of the second embodiment in that Steps S3001 and S3002 are added. After the recalibration determining process is performed in Step S1705, the screen is displayed in Step S3001 to inquire of the user about whether or not the recalibration is performed in relation to all of the color patches.

Figure 23A:
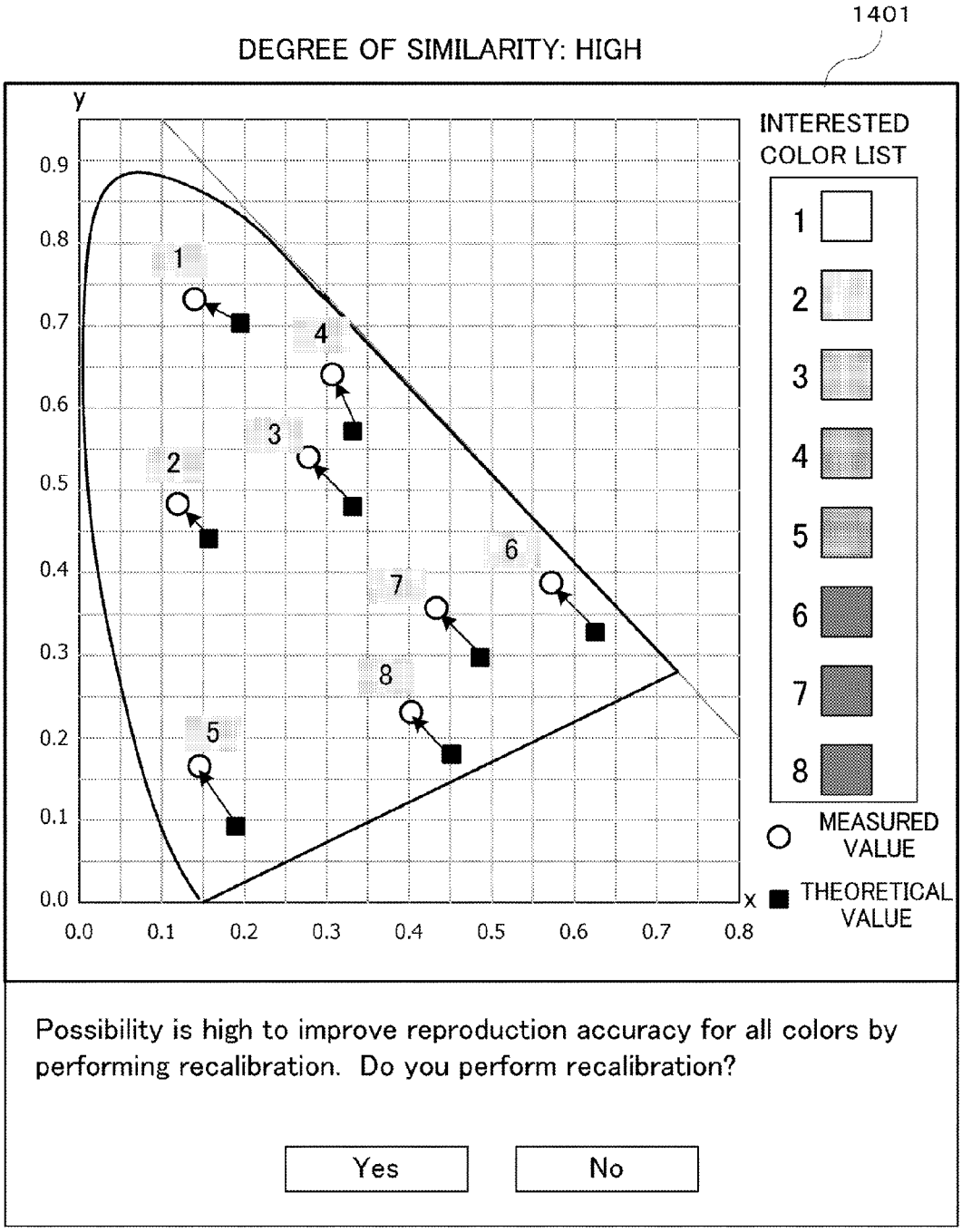
FIG. 23A and FIG. 23B show recalibration inquiry screens in relation to all color patches.
Figure 23B:
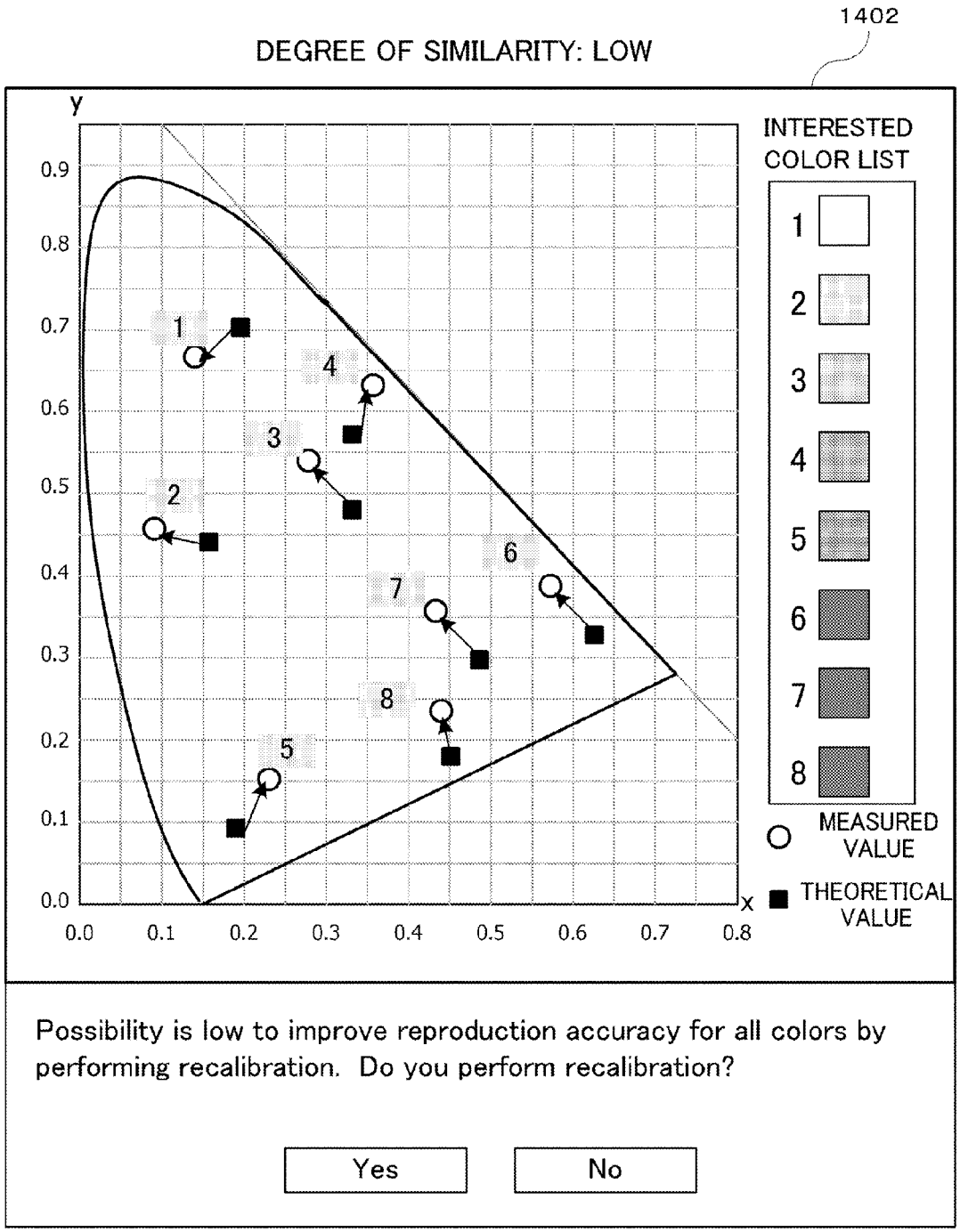

FIGS. 23A and 23B show recalibration inquiry screens in relation to all of the color patches. FIG. 23A shows an exemplary inquiry screen provided when it is determined that the execution of the recalibration is adequate in relation to all of the color patches. In the case of this inquiry screen, a message of "Possibility is high to improve color reproduction accuracy for all colors by performing recalibration. Do you perform recalibration?" is displayed.

On the other hand, FIG. 23B shows an exemplary inquiry screen provided when it is determined that the execution of the recalibration is not adequate in relation to all of the color patches. In the case of this inquiry screen, a message of "Possibility is low to improve color reproduction accuracy for all colors by performing recalibration. Do you perform recalibration?" is displayed.

If the user selects "YES" on the inquiry screen, then it is subsequently determined in Step S1706 that the recalibration is executed, and the process proceeds to Step S1709. If the user selects "NO", the process proceeds to Step S1707.

Further, after the recalibration determining process is performed in Step S1707, the screen is displayed in Step S3002 to inquire of the user about whether or not the recalibration is performed in relation to the plurality of color patches having the high degree of importance.

Figure 24A:
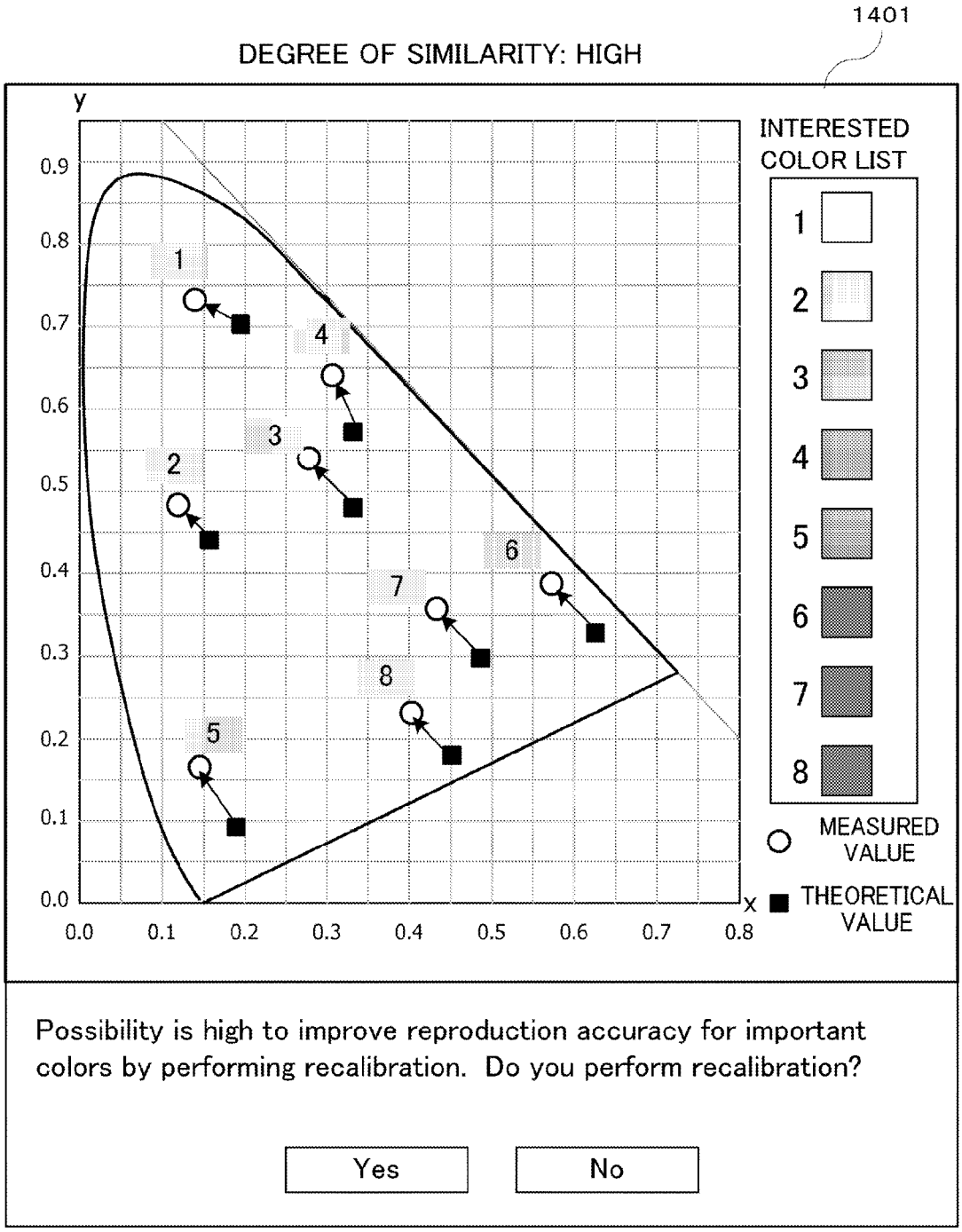
FIG. 24A and FIG. 24B show recalibration inquiry screens in relation to a plurality of important color patches.
Figure 24B:
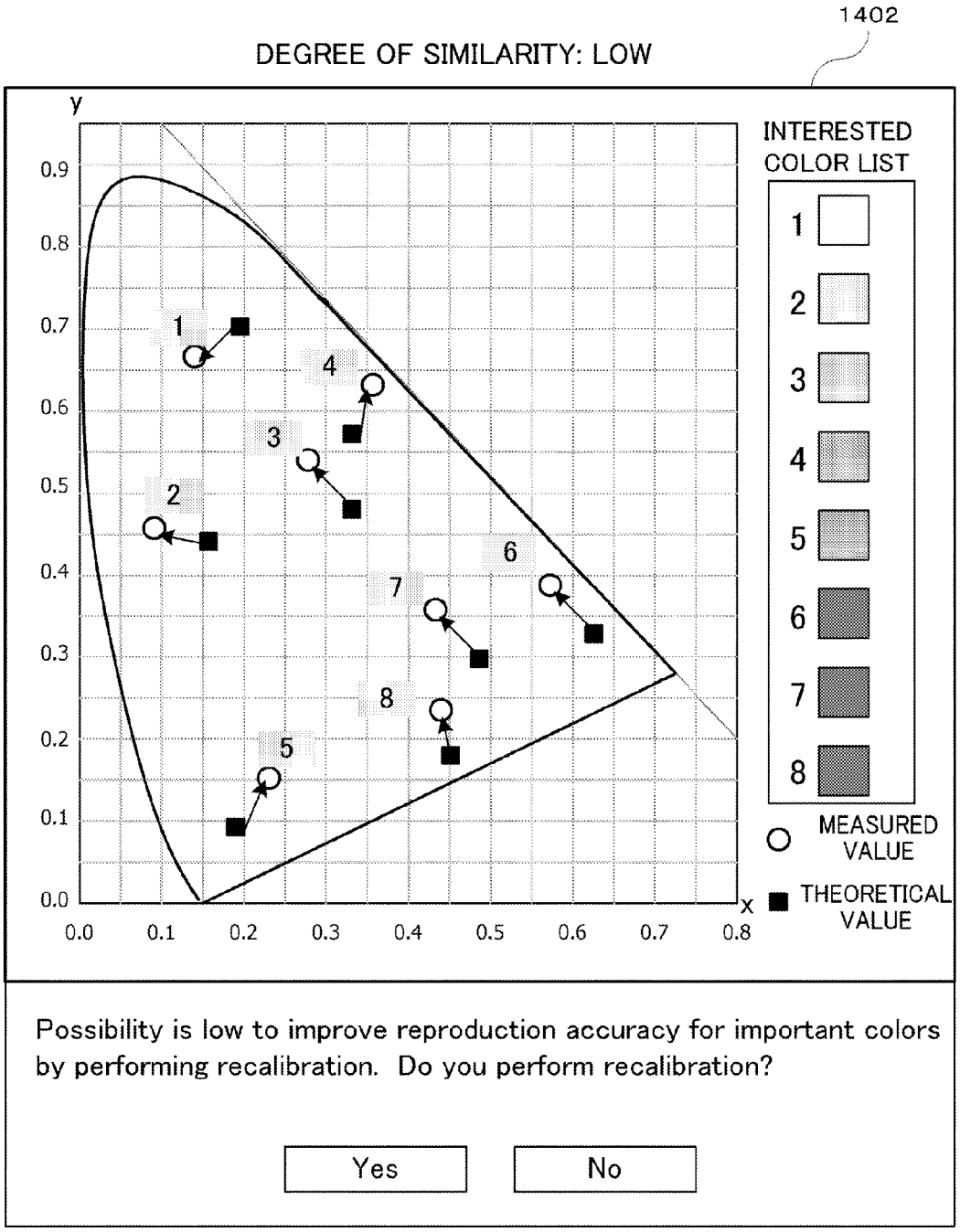

FIGS. 24A and 24B show recalibration inquiry screens in relation to a plurality of color patches having the high degree of importance. FIG. 24A shows an exemplary inquiry screen provided when it is determined that the execution of the recalibration is adequate in relation to the plurality of color patches having the high degree of importance. In the case of this inquiry screen, a message of "Possibility is high to improve color reproduction accuracy for important colors by performing recalibration. Do you perform recalibration?" is displayed.

On the other hand, FIG. 24B shows an exemplary inquiry screen provided when it is determined that the execution of the recalibration is not adequate in relation to the plurality of color patches having the high degree of importance. In the case of this inquiry screen, a message of "Possibility is low to improve color reproduction accuracy for important colors by performing recalibration. Do you perform recalibration?" is displayed.

Figure 3:
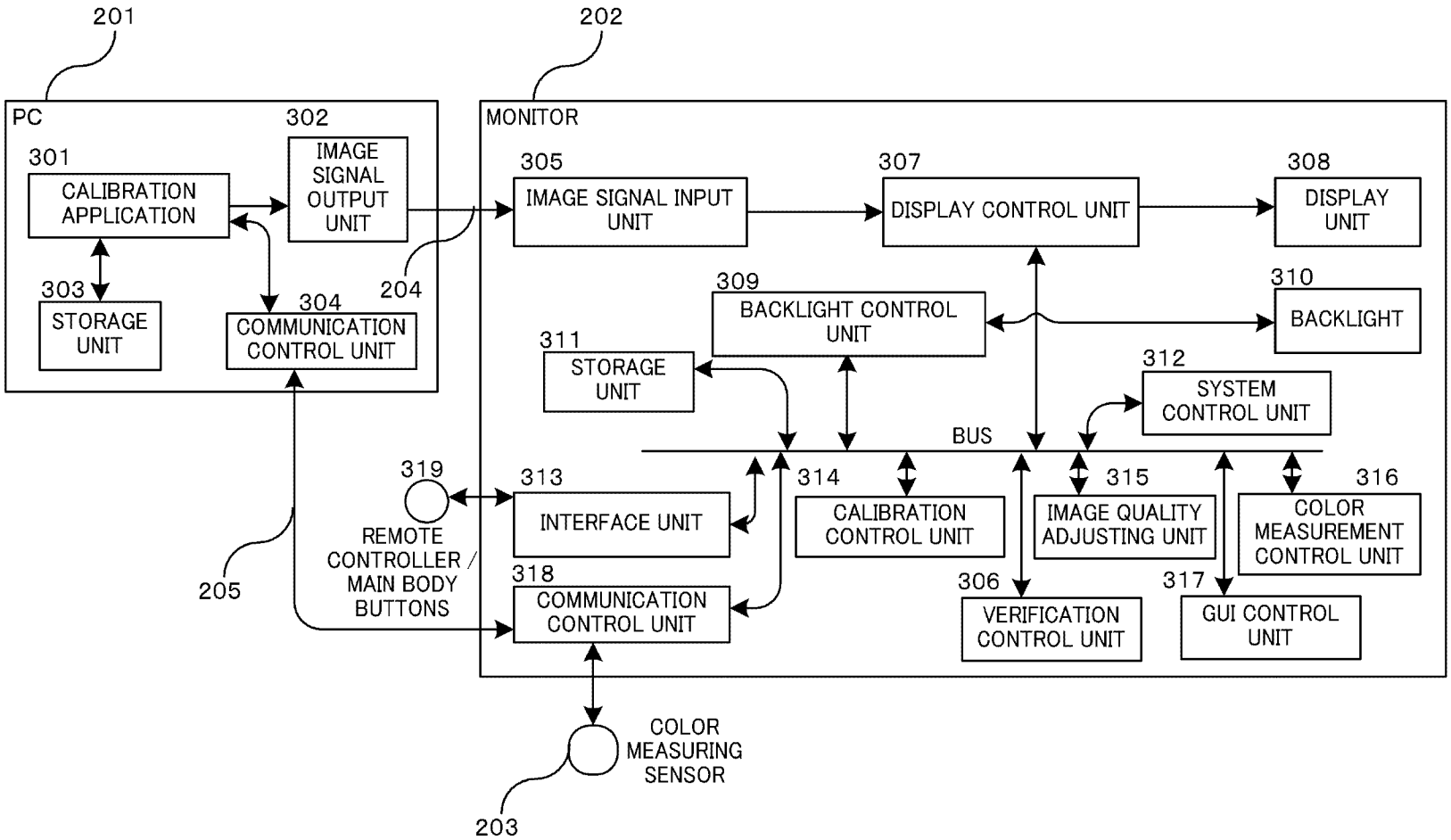
FIG. 3 shows a block diagram illustrating a system arrangement according to the first embodiment.

The inquiry screens are generated by the calibration application 301 shown in FIG. 3 or the calibration application 1601 shown in FIG. 16. If the user selects "YES" on the inquiry screen, it is subsequently determined in Step S1708 that the recalibration is executed. If the user selects "NO", the process comes to an end. According to this embodiment, the convenience is further improved for the user.

According to the respective embodiments described above, it is determined whether or not the color reproduction accuracy of the monitor is further improved by performing the calibration again, from the deviation direction between the measured value after the calibration and the theoretical value thereof. Therefore, the user can easily determine whether the state of the image quality of the monitor after the calibration is the best state or any state in which there is room for improvement. Accordingly, it is unnecessary for the user to repeatedly perform unnecessary calibration for the monitor and unnecessary confirmation operation to be performed thereafter many times.

A computer-readable recording medium itself, on which the calibration application (computer program) for realizing the functions of the foregoing embodiments, is also one of the aspects of the present invention.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., non-transitory computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-149642, filed on Jul. 3, 2012, and Japanese Patent Application No. 2013-090044, filed on Apr. 23, 2013, which are hereby incorporated by reference herein in their entirety.

What is claimed is:

1. A calibration apparatus comprising:

a processor; and a memory coupled to the processor to store instructions that cause the processor to perform operations of at least one of a plurality of steps including:

a calibration step of performing calibration for an image display apparatus;

an acquiring step of acquiring a color deviation direction that represents a direction of deviation in a color space between a color measurement value and a theoretical value, for each of color patches of a plurality of colors after executing the calibration; and a control step of determining degrees of similarity of the color deviation directions in relation to the color patches of at least some of the plurality of colors and controlling whether or not to repeat the calibration step for the image display apparatus, on the basis of a result of the determination.

2. The calibration apparatus according to claim 1, wherein a determination coefficient, which represents the degrees of similarity of the color deviation directions, is calculated in the control step in relation to the color patches of at least some of the plurality of colors, and the calibration for the image display apparatus is performed again in the calibration step if the determination coefficient is larger than a threshold value.

3. The calibration apparatus according to claim 2, wherein, in the control step, preferential color patches of a plurality of colors are selected from the color patches of the plurality of colors, a first determination coefficient which represents the degrees of similarity of the color deviation directions in relation to the color patches of all of the colors included in the plurality of colors and a second determination coefficient which represents the degrees of similarity of the color deviation directions in relation to the preferential color patches of the plurality of colors are calculated, and the calibration for the image display apparatus is performed again in the calibration step if at least any one of the first determination coefficient and the second determination coefficient is larger than a threshold value.

4. The calibration apparatus according to claim 3, wherein the second determination coefficient is calculated in the control step if the first determination coefficient is not larger than the threshold value, and the calibration for the image display apparatus is performed again in the calibration step if the second determination coefficient is larger than the threshold value.

5. The calibration apparatus according to claim 2, wherein the plurality of steps further comprising:

an input step of accepting an operation of a user in order to select preferential color patches of a plurality of colors from the color patches of the plurality of colors, wherein:

a first determination coefficient which represents the degrees of similarity of the color deviation directions in relation to the color patches of all of the colors included in the plurality of colors and a second determination coefficient which represents the degrees of similarity of the color deviation directions in relation to the preferential color patches of the plurality of colors are calculated in the control step, and the calibration for the image display apparatus is performed again in the calibration step if at least any one of the first determination coefficient and the second determination coefficient is larger than a threshold value.

6. The calibration apparatus according to claim 2, wherein:

a color deviation amount, which represents a magnitude of deviation in the color space between the color measurement value and the theoretical value, is further acquired in the acquiring step for each of the color patches; and in the control step, the calibration for the image display apparatus is not performed again in the calibration step irrelevant to a value of the determination coefficient if an average value of the color deviation amounts of the color patches of the plurality of colors is smaller than a threshold value.

7. The calibration apparatus according to claim 2, wherein:

an orientation of a color deviation vector in which a start point is a position in the color space corresponding to the theoretical value and an end point is a position in the color space corresponding to the color measurement value is acquired as the color deviation direction for each of the color patches in the acquiring step, a length of the color deviation vector is acquired as a color deviation amount; and V/S which is a ratio between V and S is calculated as the determination coefficient in the control step, wherein V represents a length of an average vector obtained by averaging the color deviation vectors of the color patches of the plurality of colors and S represents an average value of lengths of the color deviation vectors of the color patches of the plurality of colors.

8. The calibration apparatus according to claim 1, wherein the image display apparatus is allowed to display the color patches of the plurality of colors in the acquiring step, and the color measurement value of each of the color patches is acquired from a color measuring unit.

9. The calibration apparatus according to claim 1, wherein the degrees of similarity of the color deviation directions are determined in the control step in relation to the color patches of all of the colors included in the plurality of colors.

10. The calibration apparatus according to claim 1, wherein preferential color patches of a plurality of colors are selected in the control step from the color patches of the plurality of colors, and the degrees of similarity of the color deviation directions are determined in relation to the preferential color patches of the plurality of colors.

11. The calibration apparatus according to claim 1, wherein the plurality of steps further comprising:

an input step of accepting an operation of a user in order to select preferential color patches of a plurality of colors from the color patches of the plurality of colors, wherein:

the degrees of similarity of the color deviation directions are determined in the control step in relation to the preferential color patches of the plurality of colors selected by the operation of the user using the input step.

12. The calibration apparatus according to claim 1, wherein:

a color deviation amount, which represents a magnitude of deviation in the color space between the color measurement value and the theoretical value, is further acquired in the acquiring step for each of the color patches; and target values of the previous calibration are adjusted in the control step depending on the color deviation directions and the color deviation amounts of the color patches of the plurality of colors, and the calibration for the image display apparatus is performed again in the calibration step by using adjusted target values.

13. An image display apparatus comprising the calibration apparatus as defined in claim 1.

14. A method for controlling a calibration apparatus, comprising:

a calibration step of performing calibration for an image display apparatus;

an acquiring step of acquiring a color deviation direction which represents a direction of deviation in a color space between a color measurement value and a theoretical value, for each of color patches of a plurality of colors after executing the calibration; and a control step of determining degrees of similarity of the color deviation directions in relation to the color patches of at least some of the plurality of colors and controlling whether or not to repeat the calibration step for the image display apparatus is performed again in the calibration step, on the basis of a result of the determination.

15. The method for controlling the calibration apparatus according to claim 14, wherein a determination coefficient, which represents the degrees of similarity of the color deviation directions, is calculated in the control step in relation to the color patches of at least some of the plurality of colors, and the calibration for the image display apparatus is performed again in the calibration step if the determination coefficient is larger than a threshold value.

16. The method for controlling the calibration apparatus according to claim 15, wherein, in the control step, preferential color patches of a plurality of colors are selected from the color patches of the plurality of colors, a first determination coefficient which represents the degrees of similarity of the color deviation directions in relation to the color patches of all of the colors included in the plurality of colors and a second determination coefficient which represents the degrees of similarity of the color deviation directions in relation to the preferential color patches of the plurality of colors are calculated, and the calibration for the image display apparatus is performed again in the calibration step if at least any one of the first determination coefficient and the second determination coefficient is larger than a threshold value.

17. The method for controlling the calibration apparatus according to claim 16, wherein the second determination coefficient is calculated in the control step if the first determination coefficient is not larger than the threshold value, and the calibration for the image display apparatus is performed again in the calibration step if the second determination coefficient is larger than the threshold value.

18. The method for controlling the calibration apparatus according to claim 15, further comprising:

an input step of accepting an operation of a user in order to select preferential color patches of a plurality of colors from the color patches of the plurality of colors, wherein:

a first determination coefficient which represents the degrees of similarity of the color deviation directions in relation to the color patches of all of the colors included in the plurality of colors and a second determination coefficient which represents the degrees of similarity of the color deviation directions in relation to the preferential color patches of the plurality of colors are calculated in the control step, and the calibration for the image display apparatus is performed again in the calibration step if at least any one of the first determination coefficient and the second determination coefficient is larger than a threshold value.

19. The method for controlling the calibration apparatus according to claim 15, wherein:

a color deviation amount, which represents a magnitude of deviation in the color space between the color measurement value and the theoretical value, is further acquired in the acquiring step for each of the color patches; and in the control step, the calibration for the image display apparatus is not performed again in the calibration step irrelevant to a value of the determination coefficient if an average value of the color deviation amounts of the color patches of the plurality of colors is smaller than a threshold value.

20. The method for controlling the calibration apparatus according to claim 15, wherein:

an orientation of a color deviation vector in which a start point is a position in the color space corresponding to the theoretical value and an end point is a position in the color space corresponding to the color measurement value is acquired as the color deviation direction for each of the color patches in the acquiring step, a length of the color deviation vector is acquired as a color deviation amount; and V/S which is a ratio between V and S is calculated as the determination coefficient in the control step, wherein V represents a length of an average vector obtained by averaging the color deviation vectors of the color patches of the plurality of colors and S represents an average value of lengths of the color deviation vectors of the color patches of the plurality of colors.

21. The method for control ling the calibration apparatus according to claim 14, wherein the image display apparatus is allowed to display the color patches of the plurality of colors in the acquiring step, and the color measurement value of each of the color patches is acquired from a color measuring unit.

22. The method for controlling the calibration apparatus according to claim 14, wherein the degrees of similarity of the color deviation directions are determined in the control step in relation to the color patches of all of the colors included in the plurality of colors.

23. The method for controlling the calibration apparatus according to claim 14, wherein preferential color patches of a plurality of colors are selected in the control step from the color patches of the plurality of colors, and the degrees of similarity of the color deviation directions are determined in relation to the preferential color patches of the plurality of colors.

24. The method for controlling the calibration apparatus according to claim 14, further comprising:

an input step of accepting an operation of a user in order to select preferential color patches of a plurality of colors from the color patches of the plurality of colors, wherein:

the degrees of similarity of the color deviation directions are determined in the control step in relation to the preferential color patches of the plurality of colors selected by the operation of the user in the input step.

25. The method for controlling the calibration apparatus according to claim 14, wherein:

a color deviation amount, which represents a magnitude of deviation in the color space between the color measurement value and the theoretical value, is further acquired in the acquiring step for each of the color patches; and target values of the previous calibration are adjusted in the control step depending on the color deviation directions and the color deviation amounts of the color patches of the plurality of colors, and the calibration for the image display apparatus is performed again in the calibration step by using adjusted target values.

* * * * *